US009845180B2

(12) United States Patent
Rap et al.

(10) Patent No.: US 9,845,180 B2
(45) Date of Patent: Dec. 19, 2017

(54) CLOSURE ASSEMBLY FOR SQUEEZE BOTTLE COMPRISING A THERMOPLASTIC VALVE

(71) Applicant: Plasticum Netherlands B.V., Tilburg (NL)

(72) Inventors: Albertus Rap, Ede (NL); Lenny Marita Ellenkamp-Van Olst, Doetinchem (NL); Willem Ramon, Woerden (NL); Sebastiaan Wilhelmus Josephus Den Boer, Twello (NL); Shi Ming Pun, Arnhem (NL)

(73) Assignee: PLASTICUM NETHERLANDS B.V., Tilburg (NL)

( * ) Notice: Subject to any disclaimer, the term of this patent is extended or adjusted under 35 U.S.C. 154(b) by 0 days.

(21) Appl. No.: 14/765,153

(22) PCT Filed: Feb. 3, 2014

(86) PCT No.: PCT/NL2014/050065

§ 371 (c)(1),
(2) Date: Jul. 31, 2015

(87) PCT Pub. No.: WO2014/123410

PCT Pub. Date: Aug. 14, 2014

(65) Prior Publication Data

US 2016/0001936 A1 Jan. 7, 2016

(30) Foreign Application Priority Data

Feb. 5, 2013 (NL) ..... 2010248

(51) Int. Cl.
*B65D 47/20* (2006.01)
*B65D 43/16* (2006.01)

(52) U.S. Cl.
CPC ..... *B65D 47/2031* (2013.01); *B65D 43/16* (2013.01)

(58) Field of Classification Search
CPC ..... B65D 43/16; B65D 47/2031
See application file for complete search history.

(56) References Cited

U.S. PATENT DOCUMENTS 5,197,618 A * 3/1993 Goth ..... B65D 51/20 206/484.2
5,839,626 A * 11/1998 Gross ..... B65D 47/2031 222/212

(Continued)

FOREIGN PATENT DOCUMENTS

| | | | |
|---|---|---|---|
| DE | 10342406 | A1 | 3/2004 |
| WO | 2005/115861 | A1 | 12/2005 |
| WO | 2008/074517 | A2 | 6/2008 |

*Primary Examiner* — Frederick C Nicolas
*Assistant Examiner* — Bob Zadeh
(74) *Attorney, Agent, or Firm* — Hoffmann & Baron, LLP

(57) ABSTRACT

A closure assembly includes a valve for containing a substance in a squeeze bottle, a multi-layer material for providing a valve for such a closure assembly, a method for providing such a multi-layer material and a method for providing such a closure assembly. The closure assembly includes a closure cap with a cap part and a body part, a valve arranged in the body part of the closure cap, and an induction element. The induction element is arranged in the closure cap body part for induction sealing a loop shaped peripheral section of the valve to a loop shaped attachment surface of the closure cap body part.

22 Claims, 6 Drawing Sheets

(56) References Cited

U.S. PATENT DOCUMENTS

| | | | | |
|---|---|---|---|---|
| 5,934,514 | A * | 8/1999 | Lampe | B65D 47/0804 215/232 |
| 5,944,234 | A * | 8/1999 | Lampe | B65D 47/0804 222/490 |
| 8,152,016 | B2 * | 4/2012 | Berndt | B01L 3/50853 220/229 |
| 2004/0094551 | A1 | 5/2004 | Mavin et al. | |
| 2008/0233339 | A1 * | 9/2008 | Thorstensen-Woll | B65D 51/20 428/99 |
| 2010/0089921 | A1 * | 4/2010 | Ellenkamp-Van Olst | B65D 47/0809 220/254.3 |
| 2011/0163134 | A1 * | 7/2011 | Bloom | B65D 35/46 222/494 |
| 2012/0067922 | A1 * | 3/2012 | Benoit-Gonin | B65D 47/0857 222/153.06 |
| 2016/0001936 | A1 * | 1/2016 | Rap | B65D 43/16 222/490 |
| 2016/0347517 | A1 * | 12/2016 | Ellenkamp-Van Olst | B65D 47/2031 |

* cited by examiner

Fig.4a
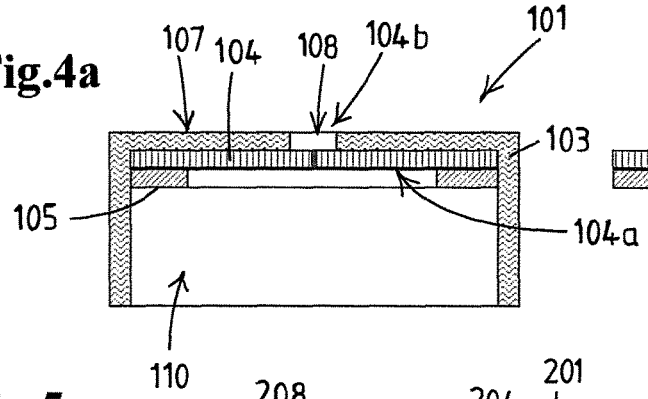
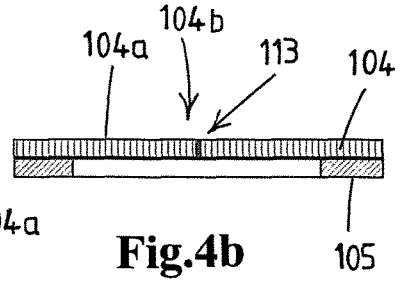
Fig.4b
Fig.5a
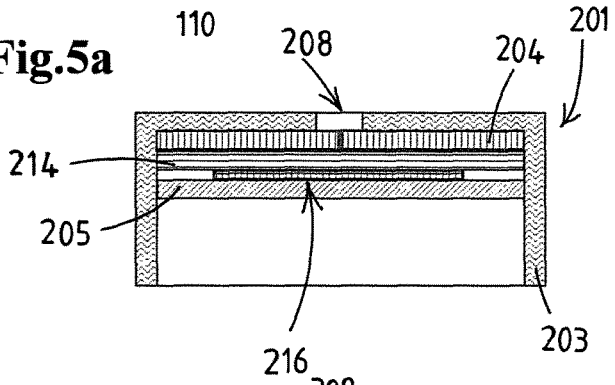
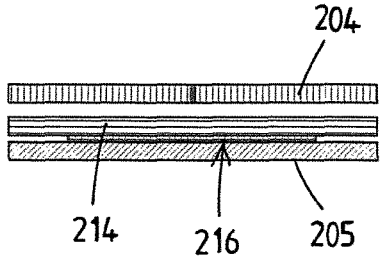
Fig.5b
Fig.6a
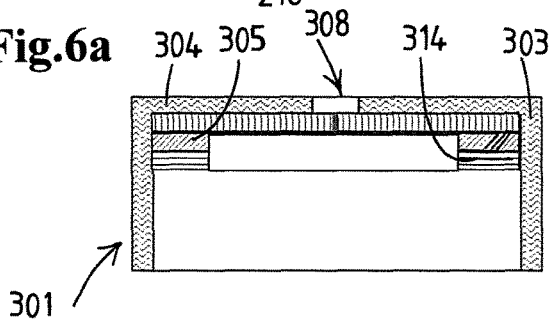
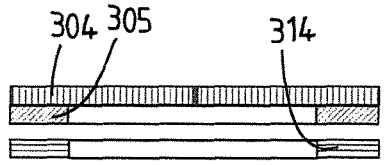
Fig.6b
Fig.7a
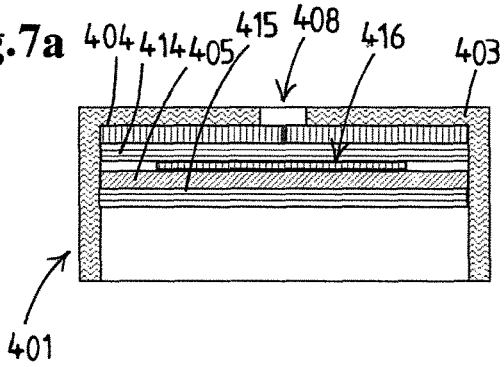
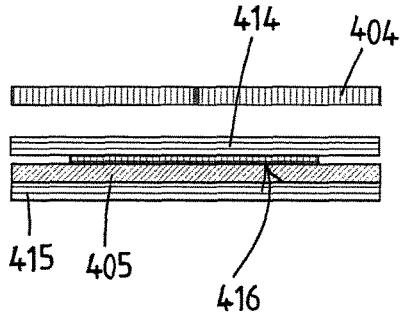
Fig.7b Fig.8a
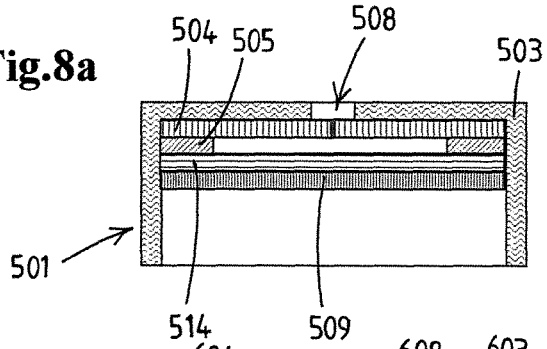
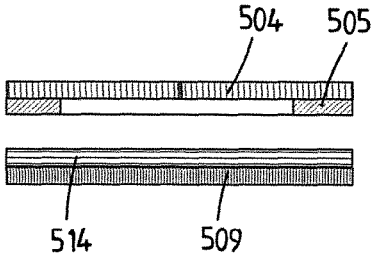
Fig.8b
Fig.9a
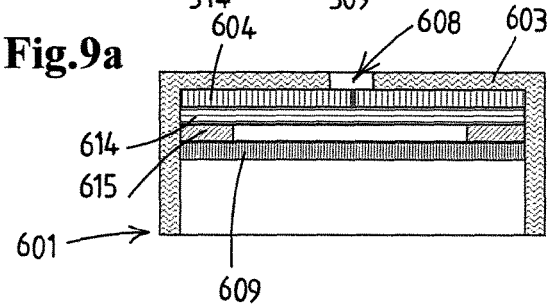
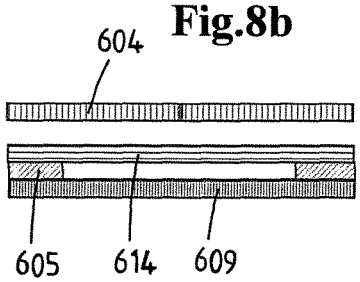
Fig.9b
Fig.10a
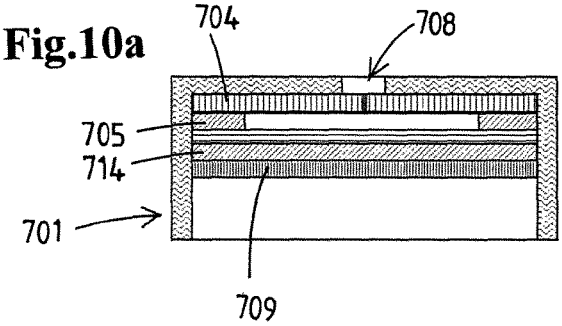
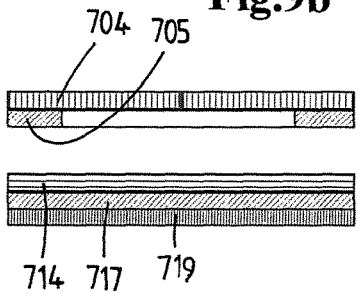
Fig.10b
Fig.11a
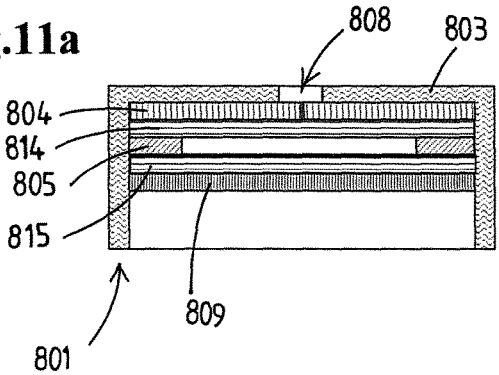
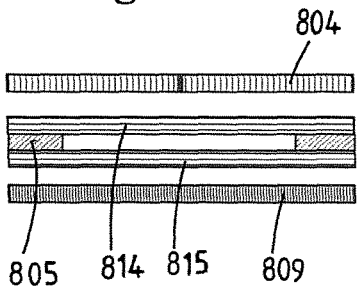
Fig.11b

CLOSURE ASSEMBLY FOR SQUEEZE BOTTLE COMPRISING A THERMOPLASTIC VALVE

CROSS-REFERENCE TO RELATED APPLICATIONS

This application is the National Stage of International Application No. PCT/NL2014/050065 filed Feb. 3, 2014, which claims the benefit of Netherlands Application No. 2010248, filed Feb. 5, 2013, the contents of which is incorporated by reference herein.

FIELD OF THE INVENTION

The present invention relates to closure assembly comprising a valve for containing a substance in a squeeze bottle, a multi-layer material for providing a valve for such a closure assembly, a method for providing such a multi-layer material and a method for providing such a closure assembly.

BACKGROUND OF THE INVENTION

It is known to provide closure assemblies for a squeeze bottle for containing a substance. Such a closure assemblies typically comprise a closure cap, the closure cap having a body part and a cap part. The body part of the closure cap is provided with a valve. The cap part is provided for covering the valve, and can be hingeably connected to the body part or be a separate element that is clicked or screwed onto the body part of the closure cap. The closure cap, more in particular its body part, is attached or can be attached to the squeeze bottle. Such a closure cap body part is typically provided with a peripheral wall and a top wall provided with a dispensing opening, and is open on the end opposite the top wall so as to be placed on an upper portion of the squeeze bottle.

These closure caps are provided with a valve, typically a resilient, self-closing valve, clamped in the closure cap body part adjacent the top wall for closing of the dispensing opening of the closure cap. The valve, after it has been placed in the body part of the cap, is typically fixed in its position in the body part of the cap by clamping. As clamping means a separate element, such as a clamping ring, can be used that is fixed over the valve in the cap. Alternatively, the closure cap body part can be locally transformed to engage the valve and fix its position.

Such closure assemblies are often produced on a first location, and combined with a squeeze bottle at another location, more in particular a squeeze bottle filling location. This because the closure assembly is to be placed on the squeeze bottle after the squeeze bottle has been filled, while construction of the closure assembly is, for example due to hygiene requirements, kept away from the filling of squeeze bottles.

The invention aims to provide an alternative closure assembly, preferably a closure assembly that allows for an alternative, preferably simple, production process and/or in an advantageous embodiment allows for reduction of material needed to provide the closure assembly, preferably allows for reduction of material needed to provide the closure cap of the closure assembly.

SUMMARY OF THE INVENTION

The present invention therefore provides a closure assembly, a squeeze bottle assembly comprising such a closure assembly, and a method for providing a closure assembly. The invention furthermore provides a method for providing a squeeze bottle with a closure assembly, a multi-layer material for providing a closure assembly and a method for providing such a multi-layer material.

The invention thus provides a closure assembly for a squeeze bottle containing a substance, the squeeze bottle having a neck part with a dispensing opening, which closure assembly is attached to or can be attached to the squeeze bottle, more in particular is placed or can be placed on the neck part of the squeeze bottle, and which closure assembly comprises:

a closure cap, which closure cap has a cap part and a body part, which body part is provided with a recess for receiving the neck part of the squeeze bottle, and wherein the body part is provided with a top wall, that forms the bottom of the recess, which top wall has an outside surface and an inside surface, and which has a dispensing opening for dispensing contents from the squeeze bottle on an outside of the closure cap body part, and wherein the top wall is on its inside surface provided with a loop shaped attachment surface extending around the dispensing opening, a valve, which valve is arranged in said recess of the closure cap body part and is adjacent the top wall such that it closes the dispensing opening, which valve is a substantially flat flexible foil material, and which valve has a loop shaped peripheral section that overlaps the loop shaped attachment surface of the closure cap body part, and which valve has a central section located in the dispensing opening of the closure cap body part, which central section is provided with at least one through slit, thus forming a resilient, essentially flat, self-closing valve, and a first induction element, which induction element is arranged in said recess of the closure cap body part for induction sealing the valve to the closure cap body part, more in particular for induction sealing the loop shaped peripheral section of the valve to the loop shaped attachment surface of the closure cap body part, which induction element is a, preferably ring-shaped, metallic foil with at least a loop shaped peripheral section that overlaps with the loop shaped peripheral section of the valve and the loop shaped attachment surface of the closure cap body part. The central section of the induction element is either provided with an opening or with an isolation material providing a barrier between the induction element and the central section of the valve and the loop shaped attachment surface of the closure cap body part, to prevent the induction element from heating the central section of the valve during the induction process.

A closure assembly according to the invention thus comprises a closure cap, a valve and an induction element for induction sealing that valve to the cap, more in particular to the closure cap body part. The invention thus provides an alternative closure assembly.

The top wall of the closure cap body part is on its inside surface provided with a loop shaped attachment surface extending around the dispensing opening of the closure cap body part, while the valve has a loop shaped peripheral section that overlaps the loop shaped attachment surface of the closure cap body part. The first induction element has a loop shaped peripheral section that overlaps with the loop shaped peripheral section of the valve and the loop shaped attachment surface of the closure cap body part for induction sealing the valve to the closure cap. By providing the loop shaped surface section on the closure cap body part and the peripheral section of the valve and induction element that both overlap the loop shaped surface section, the valve can be attached to the closure cap body part by way of induction sealing.

The induction sealing process allows for a simple construction of the closure cap, since the closure cap body part does not need reinforcement parts and/or deformable parts for attaching the valve to the closure cap body part by way of clamping. Known closure caps are provided with parts for supporting clamping means holding a valve in position and/or with parts for engaging a valve by deformation. These parts are no longer needed. Furthermore, clamping a valve in a closure cap body part with for example a clamping ring requires a rigid structured cap body part. With a closure cap according to the invention, these parts are not needed. Furthermore, the closure cap body part can be more flexible since it does not need to support clamping pressures. Thus, the closure cap body part can be made using less material.

Providing a closure assembly in which the valve is attached to the closure cap body part by way of induction sealing, enables attaching the valve to the closure cap body part after the closure cap has been placed on the squeeze bottle. Thus the valve can be attached to the closure cap body after the filling of the squeeze bottle in a filling facility. Thus the closure assembly according to the invention allows for a flexible production process. It has been observed that most filling facilities are provided with equipment for in line induction sealing for this technique is also used for sealing the squeeze bottles after filling. Thus, the closure assembly can be assembled in a production facility, while the valve and closure cap are attached to each other at a filling assembly.

In an advantageous embodiment the sealing of the squeeze bottle and the attaching of the valve to the body part of the closure cap are combined in a single induction step. Sealing of the squeeze bottle by definition takes place after filling the squeeze bottle.

The invention allows for attaching the valve to the closure cap using the known induction processes, which are already in used for sealing the squeeze bottles. Thus, the invention enables the use of existing production lines, without the need of major adaptations to be made to said lines, for sealing the valve to the closure cap of a closure assembly according to the invention.

The valve and induction element are preferably foil type materials. In an embodiment, the valve and induction element can be placed separately, in sequential production steps in the cap. In another embodiment according to the invention, the valve and the induction element are attached to each other, thus forming a multi-layer material, and positioned in the cap in a single production step.

To allow for the induction sealing, the valve and the induction element are pressed against the closure cap body part, more in particular the bottom of the recess. Thus, the valve is located directly adjacent the loop shaped attachment surface of the closure cap body part, and is located between the cap and the induction element. For attaching the valve to the cap, the assembly is subsequently subjected to induction, generating heat radiation that seals the valve to the closure cap body part. In an embodiment according to the invention, the valve and the induction element are pressed against the closure cap body part by attaching the cap to the squeeze bottle. Alternatively, a pressure body, for example a stop or a body shaped similar to the neck part of the squeeze bottle, is inserted in the recesses of the closure cap body part to press the induction element and the valve against the cap to enable induction sealing the valve to the cap.

The valve can be induction sealed during the production process of the closure assembly, or when the closure assembly has been placed upon the squeeze bottle after the filling of the squeeze bottle. In a further embodiment, the valve is sealed to the cap in the same production step as a seal is sealed to the squeeze bottle opening.

In an embodiment, the central section of the induction element is provided with an opening, such that the induction element does not cover the central section of the valve when both are placed in the recess of the closure cap body part. The opening thus provides sort of a barrier between the induction element and the central section of the valve, to prevent the induction element from heating the central section of the valve during the induction process. In an alternative embodiment, the central section of the induction element is provided with an isolation material providing an actual barrier between the induction element and the central section of the valve, to prevent the induction element from heating the central section of the valve during the induction process. These combinations of valves and induction elements are highly suitable for providing increased warmth during the induction process, without the risk of damaging the valve.

It is noted that when the induction element is not provided with a central opening, it should be removed from the cap after the induction process to allow use of the valve. Otherwise the induction element would block the discharge opening of the squeeze bottle. Removing the induction element can for example be done by the consumer when removing the seal form the squeeze bottle opening.

When the induction element is provided with an opening, it can in principle remain in the cap after the induction sealing without blocking the discharge of content form the squeeze bottle through the valve.

In an embodiment according to the invention, the closure assembly further comprises a first separator element. The separator element is made of a material that is substantially inert to the induction process, and thus does not adhere to an adjacent material, for example the neck part of the squeeze bottle, during the induction process. For example, a separator element positioned between a valve and induction element on one side, and the squeeze bottle on its opposite side, prevents the valve or parts thereof from adhering to the squeeze bottle during the induction process.

The separator is made of a material inert to the induction sealing process, for example a heat resistant plastic or foam material or cardboard or paper material. The separator preferably comprising a resilient foam material, such that it may also provide a resilient clamping force when the closure assembly is mounted on a squeeze bottle. The resilient separator can thus compensate for irregularities between the closure cap body part and the body of the squeeze bottle pressing the valve against the cap, and provide for an even clamping pressure, which is beneficial when induction sealing the valve to the cap.

The first separator element is arranged in said recess of the closure cap body part, adjacent the first induction element to enable separating the first induction element from an object located on an opposite side of the separator element, for example to enable separating the induction element from the squeeze bottle to which the closure cap is attached.

In a further embodiment, a second separator element is provided, and the first and second separator elements are provided on opposite sides of the first induction element. Preferably the separator elements comprise a resilient foam material. The foam material can be used to provide the separator elements with more structural rigidity compared to the more flexible foil type elements. Thus, the separator elements can also be used as a substrate supporting the other elements.

Preferably the first separator, the first induction element, and the second separator element are fixed to each other such that they form a laminated material. Combining the different elements in a laminate enables handling them as a single object and thus allows for placing them in the cap in a single production step. The double separators furthermore prevent the induction element from adhering to any object and thus facilitate removing the induction element after the induction process.

It is noted that to form a multi-layer material, different elements that constitute the multi-layer material are temporarily, i.e., prior to the induction process, or permanently, i.e. prior to as well as after the induction process, attached to each other. In the latter case, when two or more elements stay attached after the induction process, these materials form a laminate.

For example, a ring shaped induction element can be provided between a valve and a ring shaped separator element. When the induction element is permanently fixed to the valve, for example with a bonding material such as an adhesive, it remains attached to the valve after the valve has been fixed to the cap by way of induction. The valve and the induction element thus form a laminate. When the induction element is temporarily attached to the separator, for example by way of a bonding material that melts during the induction process such as a wax, it will no longer be attached to the separator after the valve has been fixed to the closure cap by way of induction. The induction element, more in particular the laminate comprising the induction element, and the separator thus form a multi-layer material.

Combining the elements into multi-layer materials, or even laminates, facilitates manipulating the combined materials because they can be handled as a single object, for example when positioning them inside the closure cap body part prior to induction sealing. In addition, combining them into a multi-layer material may provide a multi-layer material that is less flexible than some of its components taken separately. This is for example beneficial when manipulating foil materials, which on their own may be hard to manipulate due to their highly flexible nature.

Combining the two separator elements and the induction element in a laminate is advantageous when the separators and the induction element are to be removed after the induction process, for example by the end-user. To remove the induction element, the cap is removed from the squeeze bottle and subsequently the combined separators and induction element can be removed from the cap in a single step.

In an embodiment according to the invention the closure assembly further comprises a seal, the seal comprising at least a sealing layer for sealing the dispensing opening of the squeeze bottle, which seal is arranged in the recess of the closure cap body part such that the first separator is located between valve and the seal, and which seal has a loop shaped peripheral section that overlaps the loop shaped attachment surface of the closure cap body part. The invention thus allows for attaching the valve to the closure cap body part in the same production step in which the seal is attached to the squeeze bottle. Thus a single production step is used to induction seal two elements.

In an embodiment, the first separator is located between the valve and first induction element. This embodiment prevents the induction element from adhering to the valve as a consequence of the induction process. This configuration thus facilitates removing the induction element after the induction sealing process and is especially advantageous when the induction element is not provided with a central opening to allow use of the valve.

In a further embodiment, the first induction element is arranged adjacent the seal, and is fixed to the seal for sealing the dispensing opening of the squeeze bottle on which the closure assembly, more in particular the closure cap body part, is placed. Thus, the induction element and the valve can be positioned in the closure cap body part in a single production step.

In a further embodiment, the seal and the first induction element are fixed to each other such that they form a laminate material. The elements thus remain attached to each other after the induction process. When removing the seal from the squeeze bottle, the induction element is removed as well. The consumer simply removes the induction element and seal in a single operation, and there is no risk of for example the induction element remaining in the closure cap body part by mistake.

In a further embodiment, the first separator is fixed to the first induction element and/or the seal by way of an intermediate adhesive layer which melts at or near the induction sealing temperature, for example a layer of wax, to form a multi-layer material. Thus, the first separator, the first induction element and the seal can be positioned in the closure cap body part as a single object. After the induction process, the first separator is no longer fixed to the first induction element and the seal. The first separator can thus be removed from the cap without removing the seal from the squeeze bottle.

It is noted that "near the induction sealing temperature" should be interpreted broadly in this context. The function of the intermediate adhesive layer is to bond the elements during normal manipulation temperatures, for example between 0 and 40 degrees Celsius, and to melt above this temperature range, and melt below or near the temperatures it is subjected to during the induction process. It is not particularly relevant if the adhesive layer melts at a temperature of 2, 4 or 50 degrees below the temperatures subjected to during induction.

In an embodiment according to the invention, the closure assembly comprises an induction element, preferably in the form of a metallic foil, that covers the central section and the peripheral section of the valve, and a first separator element that preferably is disc shaped. In this embodiment, the first separator element is provided between the induction element and the valve such that the induction element does not adhere to the valve and can be removed after the induction process.

In a further embodiment, the first induction element is provided with an isolation layer on its side facing the valve, for preventing the warmth generated by the induction element during the induction process from melting the valve or part thereof, which isolation layer:

is positioned between the induction element and the valve, such that the isolation layer covers the central section of the valve and leaves the loop shaped peripheral section uncovered, or covers the central section and at least part of the peripheral section of the induction element, and openings are provided in the peripheral part of the isolation layer, such that the heat provided by the induction element during the induction process is transferred via said openings to the loop shaped peripheral section of the valve for induction sealing the valve to the cap, or covers the central section and at least part of the peripheral section of the induction element, and is a compressible material of which the barrier properties are strongly reduced when the material is compressed, such that when the closure assembly is mounted on a squeeze bottle the part of the isolation layer between squeeze bottle and valve is compressed sufficiently to pass heat generated by the induction element is transferred via the compressed material to the valve for sealing the valve to the cap while the central section is not compressed and thus maintains its solation properties such that the central section of the valve, in particular the slits provided therein, are not damaged by the heat of the induction element.

The isolation layer thus enables using a disc shaped induction element while reducing the risk that the actual valve, i.e. the central area of the valve comprising the one or more slits that function as the actual valve, gets damaged during the induction process. Such an embodiment allows for combining a disc shaped induction element with a valve for generating comparatively much heat for sealing the valve to the cap, and thus for example for use with valve having a comparatively large thickness.

In an embodiment according to the invention, the first induction element is ring shaped and has central opening such that the induction element, preferably made of metallic foil, does not cover the central section of the valve. Thus, the induction element does not need to be removed after the induction process to allow for use of the closure assembly, more in particular the valve, for dispensing content of the squeeze bottle.

In a further embodiment according to the invention, this ring shaped first induction element is located adjacent the valve for induction sealing the valve to the cap. Thus the induction element does not only not have to be removed, it furthermore allows for removing other elements, such as a separator, from the closure cap body part after the induction sealing.

In a further embodiment according to the invention, the first induction element is ring shaped, has a central opening such that the induction element does not cover the central section of the valve, is located adjacent the valve for induction sealing the valve to the cap, and the assembly further comprises a second induction element, which second induction element is arranged in the closure cap body part adjacent a seal, for induction sealing the seal to the squeeze bottle, which second induction element preferably is a disc shaped metallic foil located between the first separator element and the seal, and wherein the first separator is provided between the first and second induction element. In this particular embodiment, the separator is provided such that both induction elements can simply be separated after the induction process, and for example the ring shaped induction element can remain in the cap while the second induction element and the seal can be removed, preferably can be removed in a single step, from the squeeze bottle.

By providing a first and second induction element, one induction element can be provided close to the valve and one induction element can be provided close to the seal. Thus, valve and seal are both optimally heated during the induction process.

In a further embodiment according to the invention, the seal and the second induction element are fixed to each other such that they form a laminate. Thus, both elements can be removed after the induction process in a single action or production step.

In a further embodiment according to the invention, the laminate, comprising the seal and the second induction element, is temporarily attached to the first separator by way of an intermediate material that melts at or near the induction sealing temperature, for example a layer of wax, to form a multi-layer material. This facilitates position the elements in the cap in a single action or production step.

In an alternative embodiment according to the invention, the seal, the second induction element and the first separator are fixed to each other such that they form a laminate.

In an embodiment according to the invention, the first induction element is ring shaped and the first induction element and the valve are permanently fixed to each other such that they form a laminate. The induction element is thus attached to the closure cap body part after the induction process. In this embodiment the induction element does not need to be removed to enable dispensing of the contents of the squeeze bottle.

In a further embodiment according to the invention, the first separator, located adjacent the first induction element, is ring shaped also, preferably with dimensions similar to those of the first induction element. Thus, the separator element can remain in the closure cap body part after the induction process without blocking the dispensing openings of the respective squeeze bottle and closure assembly. In a further embodiment, the separator is fixed to the induction element. Thus, the separator is attached to the cap after the induction process, and does not need to be removed from the cap.

In an embodiment according to the invention, the first and/or second separator element are/is on one or both sides temporarily attached to an adjacent object, for example the first induction element on one side and/or the seal on an opposite side of the separator, by way of an intermediate adhesive layer which melts at or near the induction sealing temperature, for example a layer of wax, to form a multi-layer material. Thus, prior to the induction process, the combined elements can be manipulated as being a single object which for example facilitates placing the elements in the closure cap body part. After the induction process the elements that were combined using the wax material are no longer attached to each other, which facilitates removing one, for example a separator element, while leaving the other, for example the valve or the seal, in the cap or on the squeeze bottle.

In an embodiment according to the invention, the first and/or second separator element are/is an inlay, which inlay made of a compressible, non-thermoplastic material, such as a foam or paper material. The separator is for example provided with a thickness of 0.12 mm for a PE foam, or with a thickness of 0.7 mm or even more, for example with a thickness of 1 mm or 1.5 mm for example for card board materials, to further enhance the resilient properties of the element. The resilient properties of such a separator distribute the pressure exerted upon the valve and/or seal when the closure cap is placed upon the squeeze bottle, and compensates for local irregularities that may be present on sealing surface of the closure cap and/or squeeze bottle. An evenly distributed force allows for reliable high quality induction sealing.

The invention can be combined with valves of different shapes and sizes.

In an embodiment according to the invention, the valve comprises at least two through slits, which through slits extend perpendicular to each other such that they form a + shape. Other configurations of the valve opening are also possible, for example three or more intersecting through slits forming a star shape, etc.

In an embodiment according to the invention, the one or more through slits have a length between 1 and 10 mm, for example 5.5 mm or 7 mm.

In an embodiment according to the invention, the dispensing opening in the closure cap body part has a diameter between 12 and 20 mm, preferably of at least 15 mm, and/or is at opposite ends of the slit at least 2 mm wider such that the diameter of the opening is similar to the length of the slit plus 4 mm or more.

The valve is preferably made of a thermoplastic material that is suitable for induction sealing. The valve can also be provided with a layer or coating of a material that provides a bonding between closure cap body part and valve when induction sealing the valve to the cap.

In an embodiment according to the invention, the valve is made of a polyolefin material, for example a PP material, and has a thickness of 0.01-1 mm, preferably of 0.04-0.1 mm.

In an embodiment according to the invention, the valve is made of an elastomer material, for example a TPE material, and has a thickness of 0.01-1 mm, preferably of 0.04-0.1 mm.

In an alternative embodiment according to the invention, the valve is made of a natural rubber material provided on one side with a sealing layer to enable induction sealing the natural rubber to the closure cap of the closure assembly, wherein the valve has a thickness of 0.01-1 mm, preferably of 0.04-0.1 mm.

The invention furthermore provides a squeeze bottle provided with a closure assembly according to the invention.

The invention furthermore provides a closure assembly wherein the valve is part of a multi-layer material. Different elements that constitute the multi-layer material are temporarily, i.e., prior to the induction process, or permanently, i.e. prior to as well as after the induction process, attached to each other. According to the invention the multi-layer material comprises:

a, preferably disc shaped, layer of flexible thermoplastic material foil material forming the valve, which foil material has a loop shaped peripheral section for overlapping the loop shaped attachment surface of the closure cap body part and a has central section suitable for locating in the dispensing opening of the closure cap, which central section is provided with at least one through slit, such that it forms a resilient, self-closing valve of thermoplastic material, and a layer of metallic foil forming the first induction element, for being arranged in the closure cap body part for induction sealing the valve to the closure cap, which metallic foil layer preferably is ring shaped, and has a loop shaped peripheral section for overlapping with the loop shaped peripheral section of the valve.

In a further embodiment, the metallic foil is provided with at least one opening, and the layer of thermoplastic foil and the layer of metal foil are positioned relative to each other such that the at least one through slit in the thermoplastic foil is positioned in the at least one opening of the metallic foil. Thus, the metallic foil does not block the valve.

In a further embodiment according to the invention, the first induction element and the valve are fixed to each other such that they form a laminate.

In an alternative embodiment according to the invention the first induction element is a disc shaped metallic foil having a first diameter, and further comprises a disc shaped isolation element having a second diameter that is smaller than the first diameter, and which is positioned between the metallic foil and the thermoplastic foil material, such that it covers the at least one through slit provided in the thermoplastic foil material and leaves the loop shaped peripheral section uncovered.

Alternatively the isolation element covers the central section and at least part of the peripheral section of the induction element, and openings are provided in the peripheral part of the isolation element, such that the heat provided by the induction element during the induction process is sufficient for induction sealing the valve to the closure cap body part. Alternatively, the isolation element covers the central section and at least part of the peripheral section of the induction element, and is a made of a compressible material such that, when the cap is mounted on the squeeze bottle, the part between squeeze bottle and valve is compressed enough to pass heat from the induction element to the valve for sealing it to the cap while the central section of the isolation element is not compressed and thus provided isolation such that the central section of the valve, in particular the slits provided therein, is not damaged by the heat of the induction element during the induction process.

In an embodiment of a multi-layer material according to the invention, the multi-layer material, in addition to the valve and the induction element, further comprises a first separation layer, preferably made of a resilient foam material, which first separation layer is arranged adjacent the metallic foil layer such that the metallic foil layer is located between the thermoplastic foil layer and the first separation layer.

In a further embodiment, the multi-layer material further comprises the sealing layer of the seal, and the first separation layer and the seal are preferably combined to form a laminate.

In a further embodiment the multi-layer material further comprises a second separation layer. In this embodiment the first induction element is located inbetween the first and the second separation layers, and the first induction element and the separation layers are combined in a laminate that separates the valve layer from the seal. The laminate is preferably on opposite sides provided with a layer of wax for securing the valve layer and the seal layer to the laminate such that the three layers can be handled as if it is a single layer material.

The invention furthermore provides a squeeze bottle assembly comprising a squeeze bottle and a closure assembly according to the invention, wherein the squeeze bottle is provided with a neck part with a dispensing opening, and wherein the closure assembly and the squeeze bottle are each provided with attachment means, such as screw thread or click connection, which attachment means are configured for attaching, preferably releasable attach, the closure cap, more in particular the closure cap body part to the squeeze bottle, more in particular on the neck part of the squeeze bottle, such that at least the valve and the first induction element are clamped inbetween the squeeze bottle and the closure cap body part.

In a further embodiment, the squeeze bottle of the squeeze bottle assembly is provided with a flange, the flange defining the dispensing opening, which flange preferably matches the loop shaped attachment surface of the closure cap body part, such that when the closure cap body part is attached to the squeeze bottle, the peripheral section of the valve, and optionally the peripheral section of the seal, are clamped between the loop shaped attachment surface of the closure cap body part and the loop shaped flange of the squeeze bottle. The clamping force keeps the valve positioned against the closure cap and thus helps the induction sealing process.

In an embodiment according to the invention, the cap part of the closure cap, for covering the dispensing opening of the closure cap boy part and the valve provided therein, is hingeably attached to the closure cap body part. Alternatively, the closure cap body part and the closure cap cap part are separate elements. Preferably, the closure cap cap part is provided with a protrusion that fits the dispensing opening of the closure cap body part, such that when the cap part covers the dispensing opening the protruding section is positioned adjacent the valve. Thus the cap part can not only be used to close of the dispensing opening when the squeeze bottle is not used, but also supports the valve and thus prevent it from opening while the dispensing opening is not used.

The invention furthermore provides a method for providing a closure assembly, preferably a closure assembly according to the invention. The method comprises the steps:

providing a closure cap comprising a cap part and a body part;

providing a valve, positioning the valve in the body part of the closure cap;

providing an induction element;

positioning the induction element in the body part of the closure cap optionally: induction sealing the valve to the closure cap body part.

Thus, a closure assembly is provided comprising a valve suitable for induction sealing to the closure cap of the closure assembly.

In a further method according to the invention, the valve and the induction element are provided in the form of a multi-layer material, for example as a laminate, and are positioned in the closure cap body part in a single step. Thus the handling of the elements combined in the multi-layer material is facilitated.

In a further method according to the invention, prior to the optional induction sealing step, to enable sealing the valve to the closure cap body part and a seal to the squeeze bottle the closure cap is mounted on, the following steps are performed:

providing a first separator;

positioning the first separator in the closure cap body part;

providing a seal;

positioning the seal in the closure cap body part.

In a further method, the first separator and the seal are provided in the form a multi-layer material according to the invention, and the first separator and the seal are positioned in the closure cap body part in a single step, thus facilitating the production process.

The invention furthermore provides a method for providing a squeeze bottle with a closure assembly according to the invention. The method comprises the steps:

providing a dispenser squeeze bottle having a neck with a dispensing opening;

providing a closure assembly according to the invention;

positioning the closure assembly, more in particular the closure cap body part of the closure assembly, on the neck of the squeeze bottle such that at least the valve and the induction element are clamped between an upper end of the squeeze bottle neck and the top wall of the closure cap body part;

induction sealing at least the valve to the closure cap body part.

A further method according to the invention also comprises the steps:

providing the closure assembly, which further comprises a seal according to the invention;

positioning the closure assembly, more in particular the closure cap body part of the closure assembly, on the neck of the squeeze bottle such that at least the valve, the induction element, the separator and the seal are clamped between an upper end of the squeeze bottle neck and the top wall of the closure cap body part;

induction sealing the valve to the closure cap body part and the seal to the squeeze bottle neck in a single production step. By induction sealing the valve and the seal in a single production step, instead of in different production steps, the overall production process can be shortened.

An alternative method according to the invention further comprises the steps:

providing the closure assembly, which further comprises a seal according to the invention;

positioning the valve against the inner surface of the closure cap body part with a pressure body, for example a stop or a body shaped similar to the neck part of the squeeze bottle, induction sealing the valve to the closure cap body part prior to positioning the closure assembly, more in particular the closure cap body part of the closure assembly, on the neck of the squeeze bottle;

positioning the closure assembly, more in particular the closure cap body part of the closure assembly, on the neck of the squeeze bottle such that at least the induction element and the seal are clamped between an upper end of the squeeze bottle neck and the top wall of the closure cap body part;

induction sealing the seal to the squeeze bottle neck in a single production step.

With this alternative method, the valve is induction sealed to the closure cap body part as part of the assembly process of the closure assembly according to the invention, while the seal is induction sealed to the squeeze bottle only after the squeeze bottle has been filled and the closure assembly has been mounted on said squeeze bottle. Thus the benefits of a simple induction process for attaching the valve to the closure cap are combined with induction sealing the seal to the squeeze bottle.

Using a clamping body to press the valve to the closure cap body part allows for better control of the amount of pressure, and the distribution of the pressure, exerted upon the valve during the induction process. This method especially is beneficial for induction sealing a valve to a closure cap body part in cases in which the valve is dimensioned such that valve does not extend between the closure cap body part and the squeeze bottle neck, and thus is not clamped between the squeeze bottle and the closure cap when the assembly is mounted on the squeeze bottle.

The invention furthermore provides a multi-layer material for providing a closure assembly according to the invention, and a method for providing such a multi-layer material. This method comprises the steps:

providing a thermoplastic foil material;

providing an metallic foil material;

cutting at least one opening in the metallic foil material;

cutting at least one through slit in the thermoplastic foil material to create a self-closing valve;

combining the metallic foil material and the thermoplastic foil material and positioning the thermoplastic foil and the metallic foil relative to each other such that the at least one through slit is positioned within the opening in the metallic foil;

In a further method, the metallic foil material and the thermoplastic foil material are bonded into a laminate, and, optionally, the multi-layer material is die cut such that is will fit the recess of a closure cap body part of an assembly according to the invention.

A further method for providing a closure assembly according to the invention comprises the steps:

providing a sheet of separator material;

combining the sheet of separator material with the metallic foil material and the thermoplastic foil material;

optionally: bonding the separator material with the metallic foil material and the thermoplastic foil material into a multi-layer material.

A further method for providing a closure assembly according to the invention comprises the steps:

providing a sheet of sealing material;

combining the sheet of sealing material with the sheet of separator material;

optionally: bonding the separator material with the metallic foil material and the thermoplastic foil material into a multi-layer material.

With a closure assembly according to the invention, the elements placed in the recess of the closure cap body part, such as the valve, the separator element, the induction element, etc., preferably are provided with a similar contour, in particular when provide in the form of a multi-layer material. The contour of said elements preferably fits the recess, such that the elements are positioned in the recess, in particular are positioned relative to the dispensing opening of the closure cap body part, by the walls of the recess.

Advantageous embodiments of the closure assembly according to the invention, the multi-layer material according to the invention and the methods according to the invention are disclosed in the subclaims and in the description, in which the invention is further illustrated and elucidated on the basis of a number of exemplary embodiments, of which some are shown in the schematic drawing.

BRIEF DESCRIPTION OF THE DRAWINGS

In the drawings:

FIG. 4*a* shows in cross section a second closure assembly according to the invention comprising a closure cap, a valve and a first induction element;

FIG. 4*b* shows the multi-layer material of the closure assembly of FIG. 4*a* comprising the valve and the induction element for attachment to the closure cap;

FIG. 5*a* shows in cross section a third closure assembly according to the invention comprising a closure cap, a valve, a first separator element, and a first induction element with an isolation layer;

FIG. 5*b* shows the multi-layer material of the closure assembly of FIG. 5*a* split into the valve for attachment to the closure cap and a laminate comprising the first separator element, first induction element and isolation layer;

FIG. 6*a* shows in cross section a fourth closure assembly according to the invention comprising a closure cap, a valve, a first induction element and a first separator element;

FIG. 6*b* shows the multi-layer material of the closure assembly of FIG. 6*a* split into a laminate comprising the valve and the first induction element for attachment to the closure cap and the first separator element;

FIG. 7*a* shows in cross section a fifth closure assembly according to the invention comprising a closure cap, a valve, a first separator element, a first induction element with an isolation layer, and a second separator element;

FIG. 7*b* shows the multi-layer material of the closure assembly of FIG. 7*a* split into the valve for attachment to the closure cap and a laminate comprising the first separator element, first induction element, isolation layer, and the second separator element;

FIG. 8*a* shows in cross section a sixth closure assembly according to the invention comprising a closure cap, a valve, a first induction element, a first separator element, and a seal for attachment to a squeeze bottle;

FIG. 8*b* shows the multi-layer material of the closure assembly of FIG. 8*a* split into a laminate comprising the valve and the first induction element for attachment to the closure cap and a laminate comprising the first separator element and the seal for attachment to a squeeze bottle;

FIG. 9*a* shows in cross section a seventh closure assembly according to the invention comprising a closure cap, a valve, a first separator, and first induction element, and a seal for attachment to a squeeze bottle;

FIG. 9*b* shows the multi-layer material of the closure assembly of FIG. 9*a* split into a valve element for attachment to the closure cap, and a laminate comprising the first separator element, the first induction element and the seal element for attachment to a squeeze bottle;

FIG. 10*a* shows in cross section an eighth closure assembly according to the invention comprising a closure cap, a valve, a first induction element, a first separator element, a second induction element and a seal;

FIG. 10*b* shows the multi-layer material of the closure assembly of FIG. 10*a* split into a laminate comprising the valve and the first induction element for attachment to the closure cap, and a laminate comprising the separator element, the second induction element and the seal element for attachment to a squeeze bottle;

FIG. 11*a* shows in cross section a ninth closure assembly according to the invention comprising a closure cap, a valve, a first separator element, a first induction element, a second separator element and a seal;

FIG. 11*b* shows the multi-layer material of the closure assembly of FIG. 11*a* split into a valve for attachment to the closure cap, a laminate comprising the first separator element, the first induction element and the second separator element, and a seal for attachment to a squeeze bottle;

DETAILED DESCRIPTION OF THE INVENTION

Figure 1:
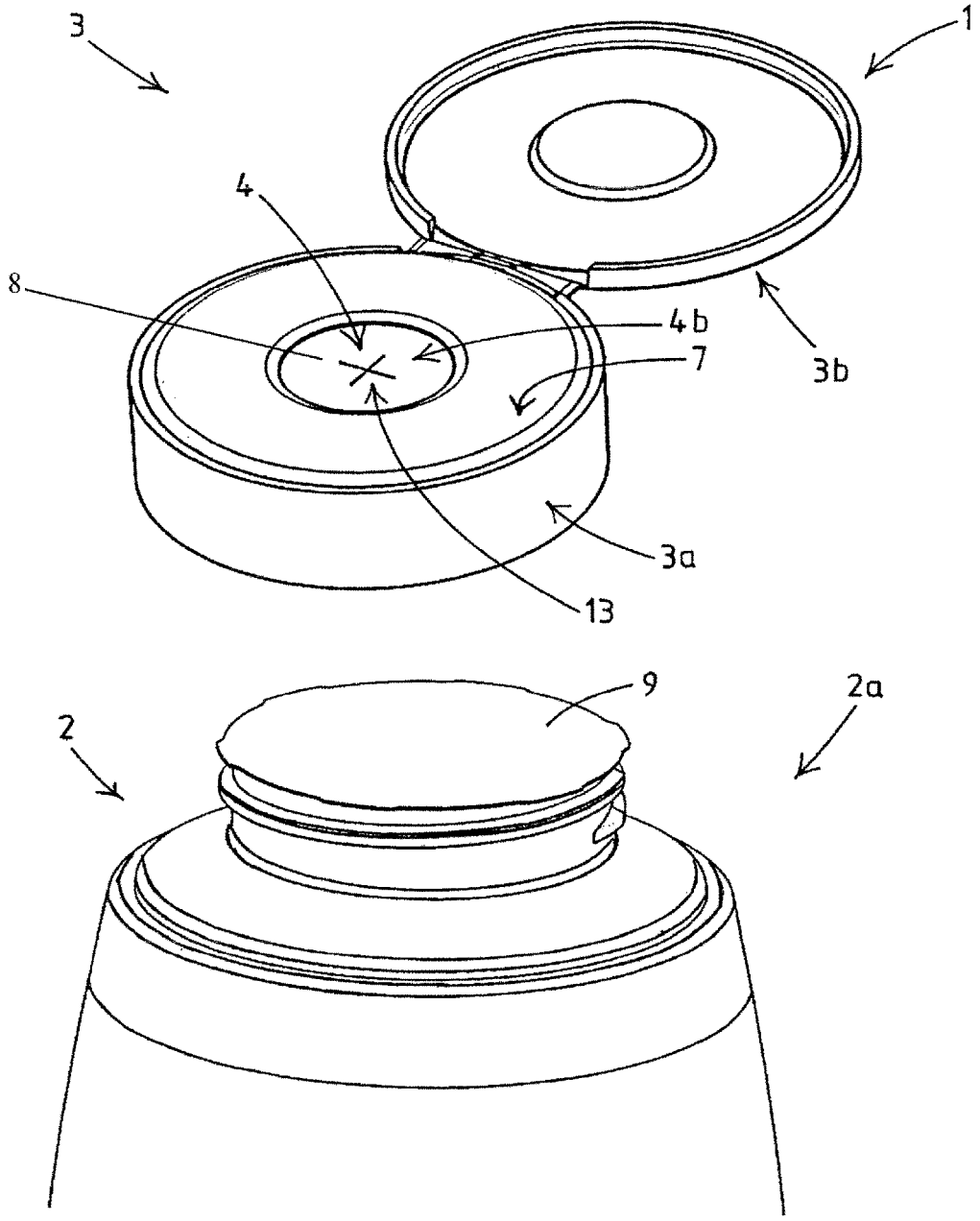
FIG. 1 shows a perspective view of a first closure assembly according to the invention.
Figure 2A:
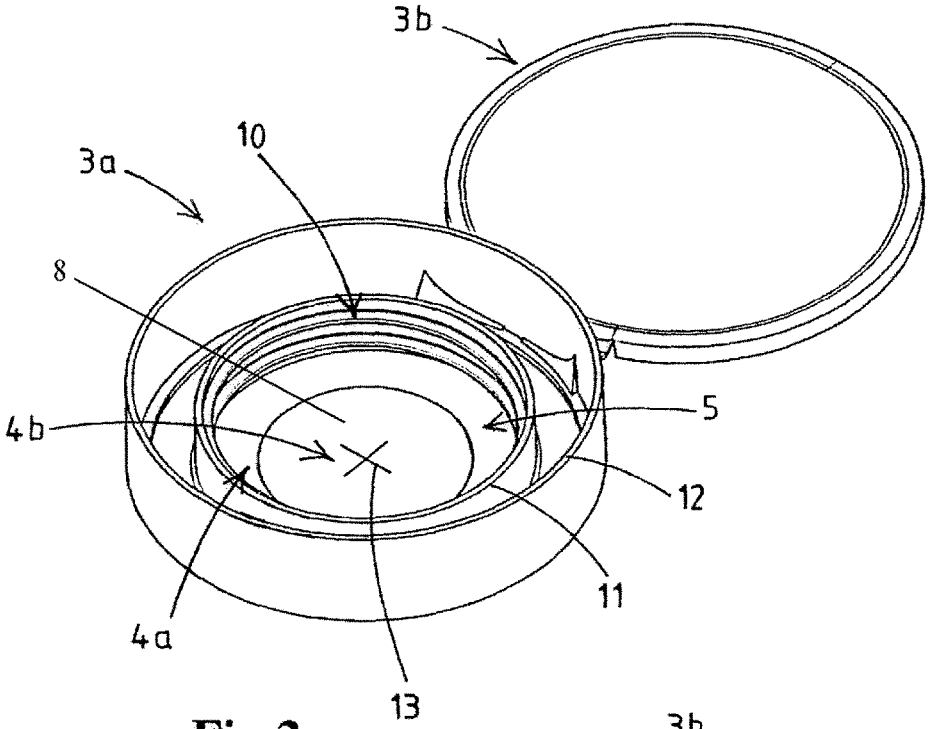
FIG. 2 shows the inside of the closure assembly of FIG. 1.
FIG. 2*b* shows the closure assembly of FIG. 2 in cross section.

FIG. 1 shows a perspective view of a first closure assembly 1 for a squeeze bottle 2 containing a substance, according to the invention. The closure assembly comprises a cap 3, having a closure cap body part 3*a* and a closure cap cap part 3*b*, a valve 4 and an induction element. In the embodiment shown the closure cap cap part 3*b* is hingeably connected to the closure cap body part 3*a*. FIG. 2 shows the inside of the closure assembly 1 shown in FIG. 1, in which the induction element 5 is visible.

FIG. 1 also shows part of a squeeze bottle 2 to which the closure assembly can be attached. The squeeze bottle 2 has a neck part 2*a* with a dispensing opening, which opening in the shown embodiment is provided with a seal 9 that seals off the dispensing opening of the neck part 2*a*.

In the particular embodiment shown in FIGS. 1 and 2, the closure assembly 1 is not attached to the squeeze bottle 2. Furthermore, in FIGS. 1 and 2 the valve 4 is induction sealed to the closure cap body part 3*a* and the seal 9 is induction sealed to the squeeze bottle 2.

It is noted that the invention relates to providing a valve that is to be attached to a cap, more in particular the closure cap body part, by way of induction sealing, preferably combined with a seal to be attached to the squeeze bottle by way of induction sealing. As such, the invention covers a closure assembly, comprising at least the closure cap, valve and induction element for heat sealing the valve to the closure cap, as well as a method for induction sealing the valve to the closure cap.

The closure assembly according to the invention shown in FIGS. 1 and 2 comprises the closure cap 3, which closure cap 3 has a closure cap body part 3*a* with a top wall 7, in which top wall 7 a dispensing opening 8 is provided for dispensing contents from the squeeze bottle 2 on an outside of the closure cap body part 3*a*.

Figure 2B:
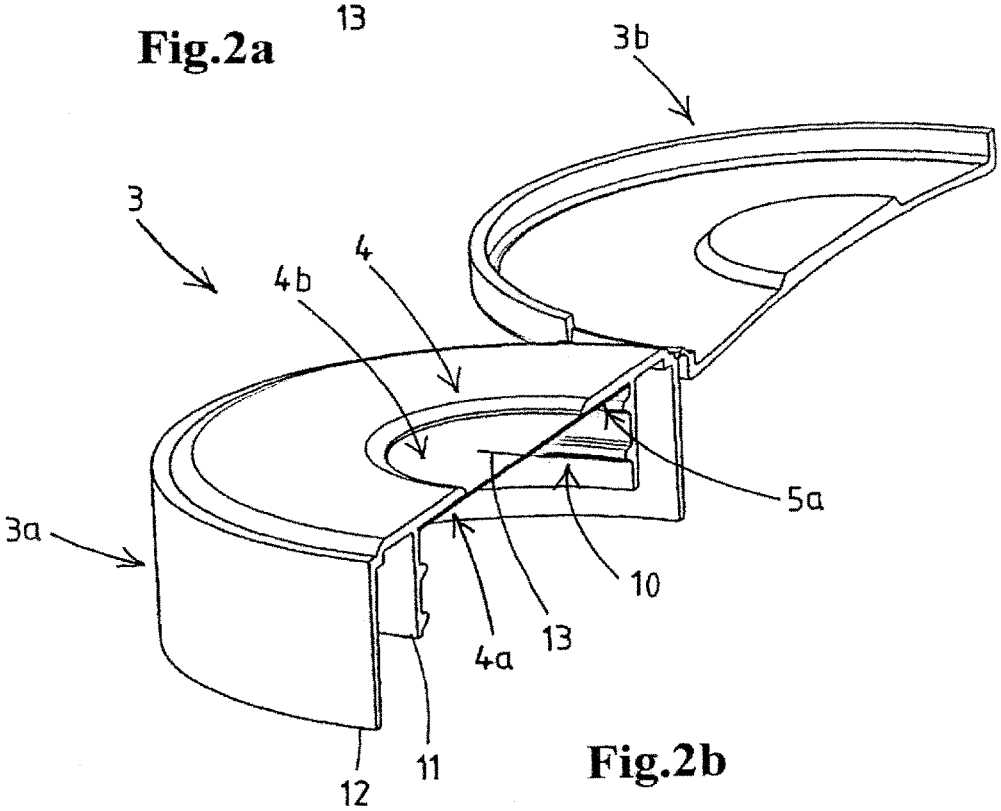

The top wall 7 has an inside surface that forms a bottom of a recess 10 in the body part 3*a* of the closure cap for receiving the neck part 2*a* of the squeeze bottle 2, which is shown in FIGS. 2 and 2*b*. In the embodiment shown, the recess 10 is formed by a circular wall 11 extending from the inside surface of the top wall 7. In the embodiment shown the body 3*a* of the closure cap 3 furthermore comprises an outer circular wall 12, and ribs extending between the first and second circular wall for providing rigidity to the closure cap body part. It is observed that many different configurations of the cap, more in particular the cap body, are possible within the scope of the invention.

The top wall 7 is on its inside surface provided with a loop shaped attachment surface extending around the dispensing opening 8. In the embodiment shown, this attachment surface is covered by the valve 4 that is located on, and is attached to, the surface.

The valve 4 is arranged in the recess 10 of the closure cap body part 3*a* and is arranged adjacent the top wall 7 such that it closes the dispensing opening 8 provided in the top wall. The valve 4 is made of a substantially flat flexible foil material, and has a loop shaped peripheral section 4*a* that overlaps the loop shaped attachment surface of the closure cap body part 3*a*. The valve 4 has a central section 4*b* located in the dispensing opening 8 of the closure cap 3, which central section 4*b* is provided with at least one through slit 13, thus forming a resilient, self-closing valve. In the embodiment shown, the valve is provided with two perpendicular, intersecting through slits forming a cross. It is noted that other configurations are also possible.

Figure 3:
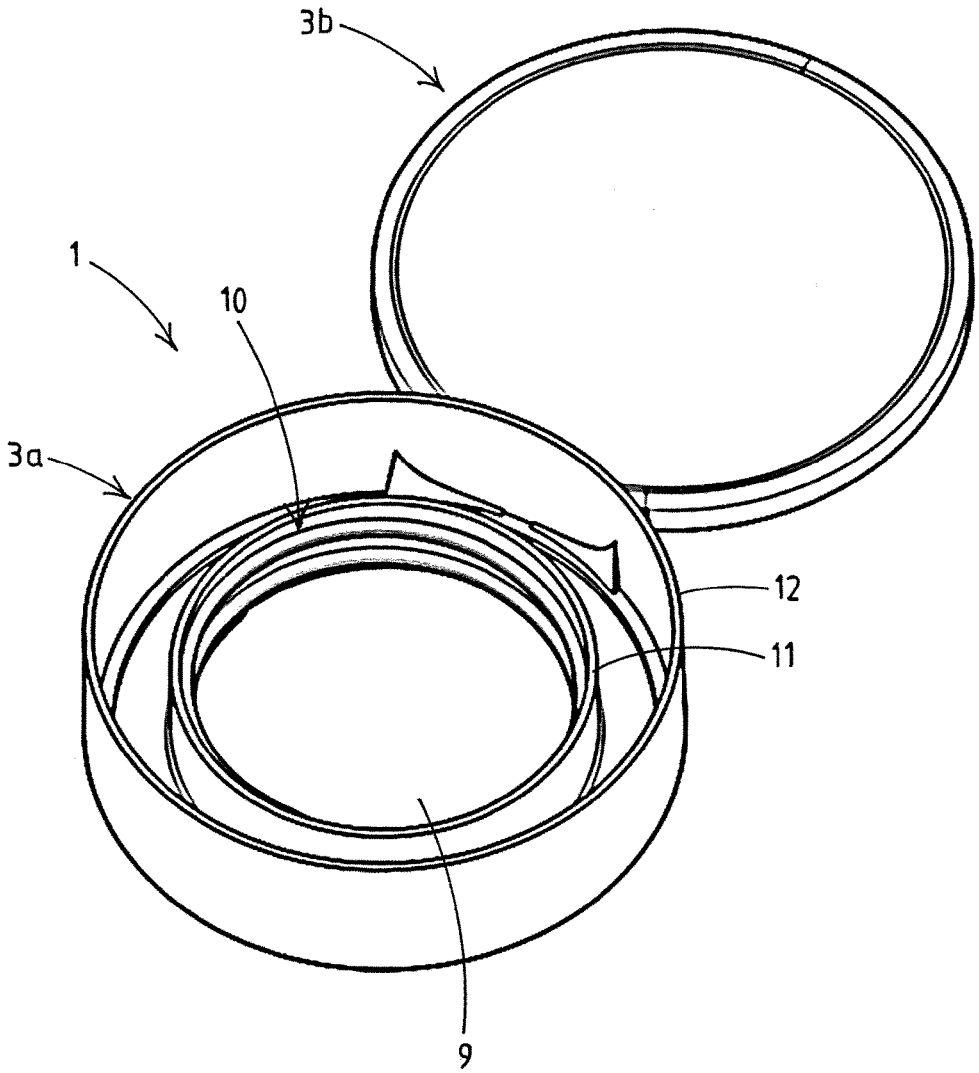
FIG. 3 shows the closure assembly of FIG. 2 provided with a seal.

In the embodiment shown in FIGS. 1-3, the recess 10 in the body part 3*a* of the closure cap is provided with screw thread, which cooperates with screw thread provided on the neck part 2*a* of the squeeze bottle 2 to mount the closure assembly on the squeeze bottle. In the embodiment shown, the valve is dimensioned such that, when seen in bottom view, i.e. when looking into the recess, it extends beyond the opening defined by the internal screw thread of the body part. Because the valve is wider than the opening defined by the internal screw thread, it can only be inserted and removed from the recess by bending the sides of the valve. Thus, when the valve has been positioned adjacent the top wall and is not yet attached to the top wall by way of induction sealing, the internal screw thread keeps the valve from falling from the recess. Furthermore, the valve is configured such that it is correctly positioned relative to the dispensing opening when its outer contour contacts the circumferential wall defining the recess. The valve is thus correctly positioned relative to the dispensing opening of the body part by the recess circumferential wall.

In an alternative embodiment, the valve, or other layers of material combined with the valve into a laminate or multi-layer material, is provided with radially extending flexible fingers, which engage the screw thread provided inside the recess and thus secure the valve in the recess. Also, in addition to or instead of screw thread, retaining devices for example protrusions such as ribs or click fingers can be provided in the recess near the top wall to hook behind the valve when it is placed inside the recess, to prevent the valve from falling from its position in the recess prior to being induction sealed to the cap.

In the embodiment shown the valve is circular shaped. It is noted that other shapes are possible, such as oval shaped, rectangular, etc. For example when the cap is provided with an oval shaped dispensing opening, the valve can be rectangular or oval shaped.

In an advantageous embodiment, such as the one shown, the outer contour of the valve matches the inner contour of the recess, for example are both circular or both oval shaped, such that, when the valve is placed in the recess, the valve is positioned by the walls of the recess in a correct position, more in particular with the one or more cross slits correctly positioned in the dispensing opening.

The first induction element 5, shown in FIG. 2, is arranged in the closure cap 3 for induction sealing the valve 4 to the closure cap 3, more in particular for induction sealing the loop shaped peripheral section 4*a* of the valve to the loop shaped attachment surface of the closure cap body part 3*a*. The induction element 5 shown is a metallic foil with a loop shaped peripheral section 5*a* that overlaps with the loop shaped peripheral section 4*a* of the valve and the loop shaped attachment surface of the closure cap body part 3*a*.

The induction element shown is thus provided with a central opening, such that the central section of the valve and the dispensing opening of the closure cap body part are not covered by the induction element. Thus, during the induction sealing process the induction element generates heat only in the section of the valve to be sealed to the closure cap body part. The central section of the valve is not, or not substantially heated which reduces the chance of damaging the valve, more in particular the through slits of the valve, during the induction process. Damage to the valve, for example sealing of part of the through slit, may hamper use of the valve for dispensing content from the squeeze bottle.

FIG. 3 shows the closure assembly 1 of FIGS. 1 and 2 prior to the induction sealing process, with the seal 9 still in the closure cap body part 3*a*. When the closure assembly comprises a seal, it is furthermore provided with at least a first separator element for preventing the seal to get attached to the valve during the induction process. Such a separator element is provided between the seal and the valve, and is thus not visible in FIG. 3. Depending on the configuration of the induction element, the separator can be provided between the valve and the induction element, between the seal and the induction element, or separator elements can be provided on opposite sides of the induction element, as will be explained in more detail below.

FIGS. 4-12 show embodiments of different configurations of a closure assembly according to the invention. Parts similar to the parts of the closure assembly shown in FIGS. 1 and 2 have been provided with similar reference signs.

It is noted that the figures, in particular the closure cap, have been simplified for explanatory reasons. In practice for example, the recess can be provided with coupling means, such as the screw thread shown in FIGS. 2 and 2*b*, for engaging coupling means of the neck part of a squeeze bottle. Furthermore, of the closure cap only the closure cap body part is depicted and not the closure cap cap part, for closing the dispensing opening, which is shown in FIGS. 1-3. The cap part preferably is configured such that, when placed on the closure cap body part, part of it lies adjacent the valve to support the valve in its flat position, i.e. the position depicted in the figures.

FIG. 4*a* shows in cross section a second closure assembly 101 according to the invention comprising a cap 103, a valve 104 and a first induction element 105.

The valve 104 has a central section 104*b* located in the dispensing opening 108 of top wall 107 of the closure cap 103, which central section 104*b* is provided with a through slit 113, thus forming a resilient, self-closing valve. The first induction element 105 is a metallic foil with a central opening, similar to the one shown in FIGS. 1-3, such that the peripheral section 104*a* of the valve is covered by the induction element and the central section of the valve, comprising the at least on through slit 113, is not. This prevents the induction element from substantially heating the central section of the valve, and thus prevents possible damage to the through slits, for example degradation of the flexibility properties of the central area of the valve. Furthermore, due to the opening, the metallic foil does not have to be removed, requiring an extra production step, after the induction sealing process to enable use of the valve.

The valve 104 and the induction element 105 form a multi-layer material, which multi-layer material is shown in FIG. 4*b* without the closure cap. It is noted that in an alternative embodiment, the valve and the metallic induction element can be separate inlays that are positioned one after the other or in a single step in the closure cap.

In the embodiment shown in FIG. 4*a*-*b*, the metallic foil and the thermoplastic foil material are fixed to each other such that they form a laminate. To form a laminate, different layers are permanently fixed to each other, for example using an adhesive, such that the layers stay connected during and after the induction sealing, and stay connected during use of the closure assembly.

In this configuration, the ring shaped aluminum foil induction element 105 stays attached to the valve 104 during and after the induction sealing. This facilitates manipulating the valve and first induction element, in particular facilitates correctly positioning of the two in the closure cap prior to the induction sealing. Furthermore, since the metal foil is attached to the valve, which in turn is attached to the cap, the risk that the metal foil, or parts thereof enter a squeeze bottle onto which the cap is placed, is reduced.

FIG. 5*a* shows in cross section a third closure assembly 201 according to the invention comprising a cap 203, a valve 204, a first separator element 214, and a first induction element 205 with an isolation element 216.

In the embodiment shown, the first induction element 205 is a disc shaped metallic foil having a first diameter. The disc shaped isolation element 216 has a second diameter which is smaller than the first diameter of the induction element, and is positioned between the metallic foil of the induction element 205 and the thermoplastic foil material of the valve 204, such that the isolation element 216 covers the at least one through slit provided in the thermoplastic foil material and leaves the loop shaped peripheral section of the valve uncovered. Thus, the central area of the valve is substantially protected from the heat generated by the induction element during the induction process. The chance of possible damage to the through slits, for example degradation of the flexibility properties of the central area of the valve due to warming of the valve material, is reduced.

The closure assembly 201 is furthermore provided with the first separator element 214 made of a material that not adheres to the valve during the induction process. The separator element 214 is provided with the valve 204 on one side and the first induction element 205 and isolation element 216 on its opposite side, to prevent the isolation element and the induction element from adhering to the valve during the induction process. Thus, after the valve has been induction sealed to the closure cap body part of the closure cap, the first separator element, the first induction element and the isolation element can be removed from the recess in the closure cap body part (after taking the cap of the squeeze bottle) to allow dispensing of contents from the dispensing opening of the squeeze bottle through the through slit of the valve. Such an embodiment can for example be used when a seal has to be removed from the squeeze bottle prior to use as well. Both elements can then be removed at the same time.

In a preferred embodiment according to the invention, the separator element is provided with lips along its perimeter which may engage screw thread or similar extensions provided in the closure cap body part to position the separator in the recess and preventing it, and thus the other elements, from falling out of the recess prior to positioning the cap, more in particular the closure cap body part, on the squeeze bottle. Lips may also be provided to facilitate engaging by hand the separator located in the closure cap body part, for example for removing the separator from the cap after the induction process. These lips can be combined with other elements also, for example with a seal for sealing the squeeze bottle.

FIG. 5*b* shows the layer material of the closure assembly of FIG. 5*a* split into the valve 204 for attachment to the cap 203 and a laminate comprising the first separator element 214, first induction element 205 and isolation element 216. By providing the first separator element, the first induction element, and the isolation element as a laminate, the three elements can be handled as a single object prior to and after the induction process.

In the embodiment shown in FIG. 5, the first separator 214 is a disc shaped element that covers the metal foil at one side and the valve at its opposite side, and thus provides a barrier between the first induction element and the valve. It is noted that in such an embodiment of a closure assembly, the first separator should be removed from its position after the valve has been induction sealed to the cap, more in particular the closure cap body part, and prior to the use of the closure assembly for dispensing substance form the squeeze bottle, to allow dispensing contents of the squeeze bottle via the valve.

In the embodiment shown in FIG. 5, the isolation element is disc shaped layer of isolating material. In an alternative embodiment, the isolation element is provided in the form of a layer isolating material that covers the central section and at least part of the peripheral section of the induction element, and are openings provided in the peripheral part of the isolation layer, such that the heat provided in the peripheral section by the induction element during the induction process is transferred via said openings to the valve for induction sealing the valve to the cap.

In a further alternative embodiment, the layer of isolation material covers the central section and at least part of the peripheral section of the induction element, and is a compressible material such that when the closure assembly is mounted on a squeeze bottle the part of the isolation layer between squeeze bottle and valve is compressed sufficiently to pass heat generated by the induction element to the valve for sealing it to the cap, while the central section of the isolation layer is not compressed and thus maintains its isolation properties such that the central section of the valve, in particular the slits provided therein, are not damaged by the heat of the induction element.

FIG. 6*a-b* and FIG. 7*a-b*, depict the closure assemblies shown in FIG. 4*a-b* and FIG. 5*a-b* respectively, which are furthermore provided with a first separator 314 and second separator 415 respectively, to prevent the induction element form adhering to and/or damaging the neck part of the squeeze bottle during the induction process.

In the embodiment 301 shown in FIG. 6, the first separator 314 is a ring shaped element, that has a loop shaped peripheral section that overlaps with the loop shaped peripheral section of the first induction element 305 and a has central section provided with an opening such that the first separator does not cover the central section of the valve. Such a first separator can either be an element that is not attached to the valve and/or the first induction element, or be an element that is temporarily attached to the valve and/or the first induction element and thus is part of a multi-layer material, or even be an element that is permanently fixed to the valve and/or the first induction element and thus is part of a laminate.

In an embodiment of a closure assembly according to the invention, the first separator is temporarily attached to the valve and/or the first induction element by way of an intermediate adhesive layer which melts at or near the induction sealing temperature, for example a layer of wax, to form a multi-layer material. During the induction sealing, the intermediate material disintegrates and/or is for example absorbed by the material the first separator is made off. The latter can be the case when the first separator is for example made of a paper or pulp material.

Providing the multi-layer material allows for easy placement in a single step of the elements making up the multi-layer material, prior to the induction sealing of the valve.

During the induction sealing, for example the connection between the first separator on the one hand and the first induction element and the valve on the other hand is weakened or even fully removed. Thus, after the induction sealing of the valve to the cap, a user can easily remove the first separator prior to using the closure assembly to dispense a substance form a squeeze bottle on which the closure assembly is placed.

FIG. 7*a* shows in cross section a fifth closure assembly 401 according to the invention comprising a closure cap 403, a valve 404, a first separator element 414, a first induction element 405 with an isolation layer 416, and a second separator element 415;

FIG. 7*b* shows the multi-layer material of the closure assembly of FIG. 7*a* split into the valve 404, for attachment to the closure cap 403, and a laminate comprising the first separator element 414, first induction element 405, isolation layer 416, and the second separator 415. Because the first separator, the induction element, the isolation element and the second separator are fixed to each other to form a laminated material, they are more easy to manipulate, for example to remove after the induction sealing of the valve and the seal. Alternatively, as with the other embodiments shown, instead of as a multi-layer material, the elements can be provided as separate inlays.

FIGS. 8-11 show a closure assembly according to the invention comprising a seal for induction sealing the dispensing opening of a squeeze bottle on which the closure assembly is placed. In the embodiments shown, the valve and the seal will be induction sealed to the closure cap and the squeeze bottle respectively during the same production step, i.e. the same induction sealing process.

FIG. 8*a* shows a closure assembly 501 according to the invention with a closure cap 503, a valve 504 and first induction element 505 according to the one shown in FIG. 4. The closure assembly furthermore is provided with a seal 509 and a first separator element 514 located between the first induction element and the seal.

FIG. 8*b* shows the layer material of the closure assembly shown in FIG. 8*a* split into a laminate comprising the valve and the first induction element for attachment to the closure cap and a laminate comprising the first separator element and the seal for attachment to a squeeze bottle.

FIG. 9*a* shows a closure assembly 601 wherein a separator element 614 is provided between a valve 604 and the induction element 605. FIG. 9*b* shows the multi-layer material of the closure assembly of FIG. 9*a* split into a valve element for attachment to the closure cap, the separator element, and the seal element for attachment to a squeeze bottle.

In the embodiment shown the first induction element is ring shaped, such that it generates heat in the peripheral section of the valve only. The first induction element is arranged adjacent the seal, and is fixed to the seal, for sealing the dispensing opening of the squeeze bottle the closure cap is placed on.

The first separator 614 is located between the valve 604 and first induction element 605. In addition, the separator is made of a resilient foam material. When the closure assembly is mounted on a squeeze bottle, the peripheral part of the separator element is compressed between the neck part of the squeeze bottle and the closure cap. The compressed section better guides heat from the induction element to the valve than the non-compressed central section of the separating element. Thus, during the induction process, the peripheral section of the valve is heated and thus sealed to the closure cap, while the central section of the valve is extra protected against the heat generated by the induction element.

FIG. 10*a* shows in cross section an eighth closure assembly 701 according to the invention comprising a closure cap 703, a valve 704, a first induction element 705, a first separator element 714, a second induction element 717 and a seal 709. FIG. 10*b* shows the multi-layer material of the closure assembly of FIG. 10*a* split into a laminate comprising the valve 704 and the first induction element 705 for attachment to the closure cap 703, and a laminate comprising the separator element 714, the second induction element 717 and the seal element 719 for attachment to a squeeze bottle.

In the closure assembly shown in FIG. 10 the first induction element is ring shaped, i.e. has a central opening, such that the metallic foil does not cover the central section of the valve. The first induction element is located adjacent the valve for induction sealing the valve to the closure cap, more in particular to the closure cap body part.

The second induction element is arranged in the closure cap adjacent the seal for induction sealing the seal to the squeeze bottle. In the embodiment shown, the second induction element is a disc shaped metallic foil located between the first separator and the seal. The first separator is provided between the first and second indicator.

FIG. 11*a* shows in cross section a ninth closure assembly 801 according to the invention comprising a closure cap 803, a valve 804, a first separator element 814, a first induction element 805, a second separator element 815 and a seal 809. FIG. 11*b* shows the multi-layer material of the closure assembly of FIG. 11*a* split into a valve for attachment to the closure cap, a laminate comprising the first separator element, the first induction element and the second separator element, and a seal for attachment to a squeeze bottle;

The first and second separators are provided on opposite sides of the first induction element. In the embodiment shown, the first separator, the first induction element and the second separator are fixed to each other such that they form a laminated material. Thus, a central induction element is provided that can be used for induction sealing both the valve to the closure cap and the seal to the squeeze bottle. The central induction element is separated from both the valve and the seal by the first and a second separator respectively. After induction sealing of the valve to the closure cap and the seal to the neck part of the squeeze bottle, the induction element and the first and second separator can be removed from between the seal and the valve, for example by the end user when removing the seal prior to using the closure assembly for dispensing substance from the squeeze bottle the closure assembly is placed on.

In the embodiment shown, the first separator, the induction element, and the second separator are fixed to each other such that they form a laminated material. Thus they are easier to manipulate, for example to remove after the induction sealing of the valve and the seal, for example by a user prior to removing the seal form the squeeze bottle.

In a further embodiment, the laminated material, comprising the first and second separator and the first induction element between them, is temporarily attached to the valve on one side and to the seal on the opposite side by way of an intermediate material that melts at or near the induction sealing temperature, for example a layer of wax, to form a multi-layer material. This facilitates manipulating the combined materials, for example when positioning them inside the closure cap, more in particular the closure cap body part, prior to induction sealing.

A closure assembly according to the invention is to be used for providing a squeeze bottle with a closure assembly, more in particular for providing a squeeze bottle with a closure assembly comprising a valve. The closure assembly allows for attaching the valve to the closure cap using induction sealing techniques.

In a further embodiment according to the invention, the closure assembly allows for attaching a seal to the dispensing opening of the squeeze bottle and attaching the valve to the closure cap in a single production step using induction sealing. A method for thus providing a closure cap with a valve and a squeeze bottle with a seal is shown in FIG. 12.

In FIG. 12 parts similar to the parts of the closure assemblies shown in the preceding Figs. have been provided with similar reference signs. Again, it is noted that the figures, in particular the depiction of the closure cap, have been simplified for explanatory reasons. Of the squeeze bottle on which the closure cap is placed, only the neck part is depicted.

Figure 12A:
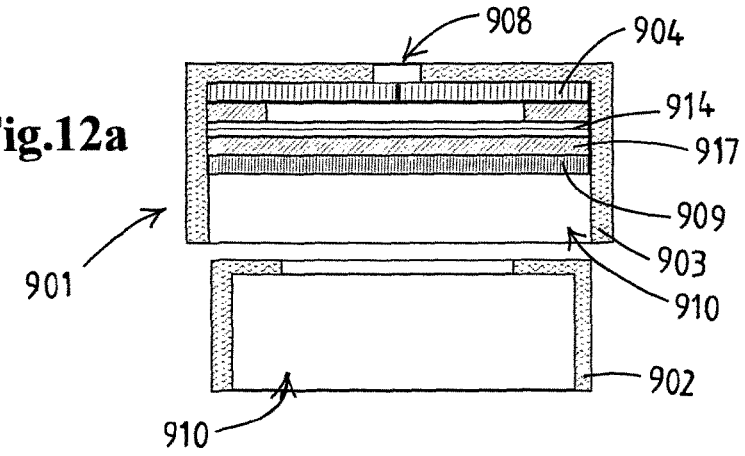
FIG. 12*a* shows in cross section a tenth closing assembly according to the invention and a neck of a squeeze bottle.

The closure assembly 901 shown in FIG. 12*a* is identical to the one shown in FIG. 10. The closure assembly comprises a closure cap 903, and a multi-layer material provided in a recess in that cap, more in particular in a recess of a closure cap body part of the closure cap, the multi-layer material comprising a valve 904, a first induction element 905, a first separator element 914, a second induction element 917 and a seal 909.

In this embodiment, the valve and the seal are each provided with an induction element. These first and second induction element are positioned adjacent the valve and the seal respectively. By providing the valve and the seal each with an induction element, the distance between the induction elements and the sections to be induction sealed to the closure cap and squeeze bottle can be kept short for an optimal heat transfer during the induction process.

The multi-layer material of the closure assembly 901 is provided with the separator elements such that, after the induction process, the multi-layer material can be split into a first laminate, comprising the valve 904 and the first induction element 917 attached to the closure cap, and a second laminate, comprising the separator element, the second induction element and the seal element, attached to a squeeze bottle.

Figure 12B:
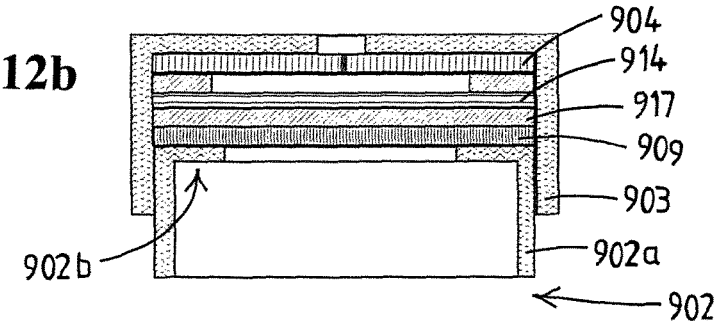
FIG. 12*b* shows the closing assembly of FIG. 12*a* placed on the squeeze bottle of which the neck with a dispensing opening is shown.

To attach the valve and the seal of the closure assembly to the closure cap and a squeeze bottle, the closure cap is positioned on a squeeze bottle 902, more in particular the closure cap body part is placed on the neck part 902*a* of a squeeze bottle 902, such that the dispensing opening 908 of the closure cap 903 is positioned over the dispensing opening of the squeeze bottle, as shown in FIG. 12*b*.

Preferably, the cap is provided with attachment means (not shown in the Figs.), such as screw threat, click fingers, a click rib, etc, for attaching the cap to the squeeze bottle and clamping the multi-layer material between the closure cap and the squeeze bottle.

Preferably, the squeeze bottle is provided with a neck part having a dispensing opening and a flange 902B defining that dispensing opening, for example as the squeeze bottle shown in FIG. 12. By providing the squeeze bottle with such a flange, the pressure exerted upon the multi-layer material extends over a larger area, which benefits the induction sealing the valve to the closure cap and the seal to the squeeze bottle. Preferably, the flange of the squeeze bottle matches the loop shaped attachment surface of the closure cap body part, such that when the closure cap is attached to the squeeze bottle, the peripheral section of the valve, and optionally the peripheral section of the seal, is clamped between the loop shaped attachment surface of the closure cap body part and the loop shaped flange of the squeeze bottle. Thus, the valve is optimally pressed against the inner surface of the top wall of the closure cap, and the seal is optimally pressed against the top surface of the flange of the squeeze bottle for sealing the valve and the seal to the respective surfaces.

With the closure assembly according to the invention is placed on the neck part of a squeeze bottle, and the multi-layer material is clamped between the closure cap and the squeeze bottle, the combined squeeze bottle and closure assembly can be subjected to the induction sealing process for induction sealing the valve top the closure cap, and in the embodiment shown, the seal to the squeeze bottle, as is shown in FIG. 12*b*.

Figure 12C:
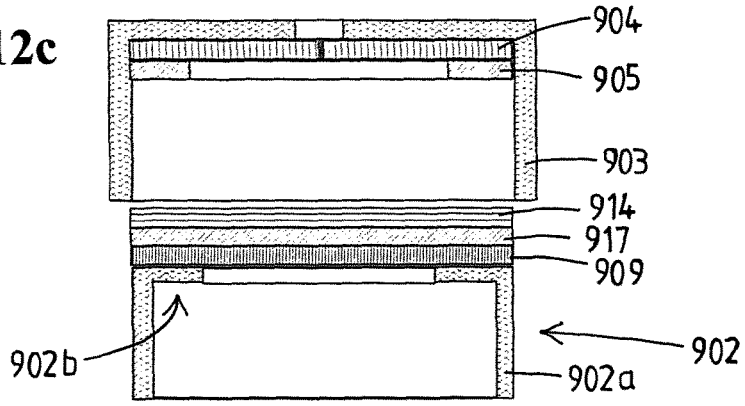
FIG. 12*c* shows the closing assembly of FIG. 12*b* after induction sealing the valve to the closure cap and the seal to the dispensing opening of the squeeze bottle, with the closure cap removed from the squeeze bottle.

During the induction process, the separating element prevents elements positioned on opposite sides of the separating element from getting attached to each other. When the closure cap is subsequently removed from the squeeze bottle, the valve remains attached to the closure cap, and, in the embodiment shown, the seal remains attached to the squeeze bottle, as is shown in FIG. 12*c*.

In the embodiment shown, the first separator 914 is on one side permanently fixed to the second induction element 917, and on its opposite side temporarily attached to the first induction element 905. The first separator is attached to the first induction element by way of an intermediate adhesive layer of wax (not shown in the Figs.), to form a multi-layer material. The wax melts at the induction sealing temperature such that during the induction process bonding between the separator element and the first induction element is removed. Preferably the separator is made of a material that absorbs the molten wax, for example is made of a paper or foam material.

Prior to use of the squeeze bottle for dispensing the contents thereof, the seal is to be removed from the squeeze bottle. In the particular embodiment shown in FIG. 12, the separator element, the second induction element and the seal are attached to each other such that they form a laminate. Thus, by removing the seal, the elements combined therewith are also removed. In an alternative embodiment, for example the seal and the induction element are combined in a laminate without the seal, allowing for removing these elements prior to removing the seal from the squeeze bottle.

Figure 12D:
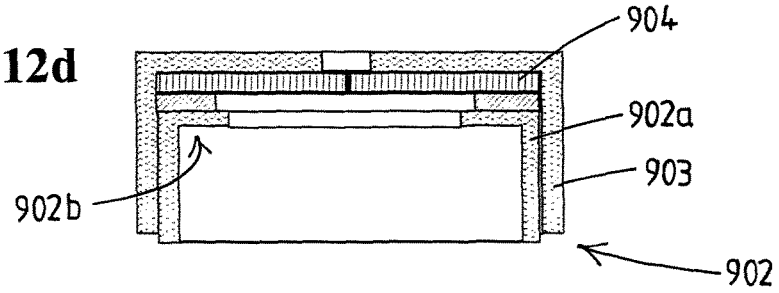
FIG. 12*d* shows the closing assembly of FIG. 12*c* replaced on the squeeze bottle with the laminate comprising the seal removed from the squeeze bottle.

After the seal has been removed, the cap with the valve and the first induction element attached thereto is again placed on the squeeze bottle, as is shown in FIG. 12D. The contents of the squeeze bottle can now be dispensed using the valve of the closure assembly.

In the embodiment shown, the first induction element is ring shaped and attached to the valve. Because of its ring shape it does not block the dispensing opening of the closure cap body part and the through slits of the valve. The first induction element does not need to be removed from the closure cap to enable use thereof. In an alternative embodiment, the first induction element can for example be a separate element, or be combined with a laminate comprising the valve, etc., and is removable from the closure cap body part after the induction process.

It is noted that when the closure assembly only comprises a valve and not a seal, a first separator element can be provided that is arranged in the recess of the closure cap and adjacent to the first induction element to enable separating of the induction element from an object located on an opposite side of the separator element. For example, when a ring shaped induction element is attached to the valve, a separator element can be provided on the side of the induction element facing away from the valve to prevent the induction element and/or the valve from adhering to the squeeze bottle during the induction process. When the separator is provided with isolation properties, it can substantially block the heat of the induction element during the induction process, thus preventing damage to the neck part of the squeeze bottle.

The first and/or second separator of a closure assembly according to the invention can be provided in the form of an inlay. The separator elements can be made of a compressible, non-thermoplastic material, such as a foam material, for example PE foam, or paper material.

In addition to the elements of the embodiments shown, other elements can be provided in the multi-layer material comprising at least the valve and the first induction element. For example an extra support element, comprising one or more layers of paper and/or plastic foil material, can be provided to provide the multi-layer material, or a laminate with extra strength. Also a layer of foam material with resilient properties can be provided, to compensate for irregularities in the surfaces of the squeeze bottle and the closure cap between which the multi-layer material is clamped. Such a resilient layer can be combined with a layer of material that does not adhere to certain materials, for example the material the valve is made of, to form a separator element with both resilient properties.

Furthermore, the elements can be provided with coatings, for example a wax coating to temporarily attach an element to an adjacent element, or for example with a plastic coating to facilitate attaching an element to a cap or squeeze bottle by way of induction sealing.

It is observed that combining different materials in a multi-layer material or even in a laminate allows for handling the elements as a single object. Furthermore, the compound object is comparatively stiff compared to individual components themselves. Combining the different elements in a single object is especially advantageous when working with thin flexible materials, such as foils type materials. Combining the different materials in a multi-layer material thus facilitates using a foil type material for a valve.

The invention furthermore provides a closure assembly wherein the valve is part of a multi-layer material. Different elements that constitute the multi-layer material are temporarily, i.e., prior to the induction process, or permanently, i.e. prior to as well as after the induction process, attached to each other. According to the invention the multi-layer material comprises:

a, preferably disc shaped, layer of flexible foil material forming the valve, which foil material has a loop shaped peripheral section for overlapping the loop shaped attachment surface of the closure cap and a has central section suitable for locating in the dispensing opening of the closure cap, which central section is provided with at least one through slit, thus forming a resilient, self-closing valve of preferably a thermoplastic material, and a layer of metallic foil for forming the first induction element, for being arranged in the closure cap for induction sealing the valve to the closure cap, which metallic foil layer preferably is ring shaped, and has a loop shaped peripheral section for overlapping with the loop shaped peripheral section of the valve.

The invention thus also provides a multi-layer material, herein also referred to multi-layer element, which may comprise one or more temporarily combined laminates. The invention furthermore provides a method, for providing such a multi-layer material.

A multi-layer material for providing a closure assembly according to the invention can for example be provided using a method comprising the steps:

providing a foil material, preferably a thermoplastic foil material, for providing a valve;

providing an metallic foil material for providing an induction element;

cutting at least one opening in the metallic foil material, preferably providing a ring shaped induction element;

cutting at least one through slit in the thermoplastic foil material to create a self-closing valve;

combining the metallic foil material and the thermoplastic foil material and positioning the thermoplastic foil and the metallic foil relative to each other such that the at least one through slit is positioned within the opening in the metallic foil.

optionally: bonding the metallic foil material and the thermoplastic foil material into a laminate, and, optionally, die cutting the multi-layer material such that is will fit the recess of a cap of an assembly according to the invention.

Depending on the configuration of the closure assembly to be provided the metallic foil material and the thermoplastic foil material can be combined into a multi-layer material, i.e. temporarily or permanently fixed to each other. It is observed that when elements are permanently fixed to each other, i.e. remain fixed to each other after the induction sealing process, they form a laminate. The laminate thus is a specific type of multi-layer material.

It is furthermore observed that the outer contour of the layers of material forming the specific elements can be cut prior to, or after combining the materials. In the latter case, for example a layer of foil material provided with through slits is combined with a layer of metallic foil provided with multiple openings, which openings are positioned such that when both layers are combined, each of the openings in the metallic foil encloses one or more through slits for forming a valve.

After the sheets individual sheet materials have been combined, the combined sheets are cut in on or more individual multi-layer materials, or multi-layer elements, each for placement in a closure cap, more in particular the body part of a closure cap. The multi-layer materials for example each comprise a layer forming the valve, a layer forming the induction element and a layer forming the separator. By thus providing the multi-layer materials, or multi-layer elements, for a closure assembly according to the invention, the different elements are provided with substantially identical circumferences.

In a further method according to the invention, the multi-layer material, or multi-layer element, for placement in the closure cap is also provided with a layer of separator material. The layer of separator material can be provided for preventing layers of the multi-layer material to seal to each other or to seal to the squeeze bottle during the induction process.

This further method comprises the additional steps:

providing a sheet of separator material;

combining the sheet of separator material with the metallic foil material and the thermoplastic foil material;

optionally: bonding the separator material with the metallic foil material and the thermoplastic foil material into a multi-layer material.

In a further method according to the invention, the multi-layer material, or multi-layer element, for placement in the closure cap is also provided with a layer of sealing material to provide a seal on the opening of the squeeze bottle. The seal is attached to the squeeze bottle by way of induction sealing, preferably during induction sealing the valve to the closure cap. A layer of separator material can be provided for preventing layers of the multi-layer material to seal to each other or to seal to the squeeze bottle during the induction process.

This further method comprises the additional steps:

providing a sheet of sealing material;

combining the sheet of sealing material with the sheet of separator material;

optionally: bonding the separator material with the metallic foil material and the thermoplastic foil material into a multi-layer material.

The invention furthermore provides a method for providing a closure assembly according to the invention. A closure assembly according to the invention can be provided with a method comprising the steps:

providing a closure cap comprising a cap part and a body part;

providing a valve, positioning the valve in the body part of the closure cap;

providing an induction element;

positioning the induction element in the body part of the closure cap.

In a preferred method, the valve and the induction element are combined to form a multi-layer material as described above, for example in the form of a laminate, which multi-layer material is placed in the body part of the closure cap in a single step. Thus, a closure assembly comprises a closure cap, and a multi-layer element provided in a body part of said closure cap, which multi-layer element comprises at least a valve and an induction element for induction sealing said valve to the body part of said cap. The closure assembly can in turn be placed on a filled squeeze bottle, after which the filled squeeze bottle can be passed through an induction device for induction sealing the valve to the closure cap.

In a further method for providing a closure assembly according to the invention a separator is provided for preventing certain elements of the multi-layer material, for example a sealing layer and a valve layer, from attaching to each other, or for preventing certain elements of the multi-layer material, for example the induction material, from attaching to the squeeze bottle. Such a further method comprises the additional steps:

providing a first separator;

positioning the first separator in the body part of the closure cap.

The separator can be provided between the valve and the induction material, or may be provided on the side of the multi-layer material opposite the side at which the valve is provided, to prevent the multi-layer material or parts thereof the attach to the squeeze bottle during the induction process. Preferably the separator is combined with the valve and the induction element in a multi-layer material.

It should be clear to the skilled person that the different closure assemblies described in this document can be obtained with a method according to the invention, for example by adding further layers of materials, such as a sealing layer for sealing a squeeze bottle, by providing the different elements in the form of a multi-layer material, which multi-layer material may be or comprise a laminate of different materials.

When the valve and the induction element are provided in the form of a multi-layer material according to the invention, or more in particular as a laminate according to the invention, they can be positioned in the cap in a single step.

The invention furthermore provides a method for providing a squeeze bottle with a closure assembly according to the invention, the method comprising the steps:

providing a dispenser squeeze bottle having a neck with a dispensing opening;

providing a closure assembly according to the invention, preferably using a method according to the invention;

positioning the closure assembly, more in particular the closure cap body part of the closure assembly on the neck of the squeeze bottle such that at least the vale and the induction element are clamped between an upper end of the squeeze bottle neck and the top wall of the closure cap body part;

induction sealing at least the valve to the body part of the closure cap.

The invention furthermore provides a method for providing a squeeze bottle with a seal on its dispensing opening using a closure assembly according to the invention. Preferably, the squeeze bottle is sealed while induction sealing the valve to the closure cap, more in particular to the closure cap body part. The further method comprises the steps:

providing the squeeze bottle with a closure assembly comprising a seal in addition to at least the valve, induction element and separator;

positioning the closure assembly, more in particular the closure cap body part of the closure assembly, on the neck of the squeeze bottle such that at least the valve, the induction element, the separator and the valve are clamped between an upper end of the squeeze bottle neck and the top wall of the closure cap body part, and wherein the valve is positioned against the cap, the seal is positioned against the squeeze bottle, and the separator and the induction element are provided between the valve and the seal;

induction sealing at least the valve to the closure cap body part and the seal to the squeeze bottle neck in a single production step.

The invention furthermore provides a method for providing a squeeze bottle with a closure assembly wherein the valve is induction sealed to the closure cap in a first production step and the seal is induction sealed to the neck of the squeeze bottle in a separate production step.

In such a method, the closures assembly comprises at least a closure cap, a valve, one or more induction elements, and at least a seal for sealing the squeeze bottle onto which the closure cap is to be placed. Preferably these components are provided in the form of a multi-layer material, and are positioned in the cap in a single production step. The one or more induction elements are positioned between the valve and the seal for, in a first induction sealing step, induction sealing the valve to the closure cap, and for, in a second induction sealing step, induction sealing the seal to the squeeze bottle. In this particular method, the first induction sealing step is performed prior to placing the closure cap on the squeeze bottle, and the second induction sealing step is performed after placing the closure cap on the squeeze bottle.

Thus, in this method according to the invention, the valve and the seal of the closure assembly are induction sealed to the closure cap and the squeeze bottle in separate induction sealing steps, more in particular, the valve is induction sealed to the closure cap prior to positioning the closure cap, more in particular the closure cap body part, on the squeeze bottle, and the seal is induction sealed to the squeeze bottle after the closure assembly has been positioned on the squeeze bottle.

During the first inductions step, a pressure body, for example a stop or a body shaped similar to the neck part of the squeeze bottle, is inserted in the recesses of the closure cap body part to press the elements, in particular the valve, against the inner surface of the closure cap body part to enable induction sealing the valve to the closure cap. Subsequently the induction element is heated and the valve is sealed to the closure cap. The stop is removed and the closure assembly, with the valve fixed to the closure cap, is processed further, for example transported to a squeeze bottle filling station.

When the closure assembly is positioned on a filled squeeze bottle, such that at least the induction element and the seal are clamped between the closure cap, more in particular the closure cap body part, and the squeeze bottle, the induction element is heated and the seal is induction sealed to the squeeze bottle.

The above can be achieved by using one induction element for providing heat to both the valve and the seal, or by providing two dedicated induction elements, one for the valve and one for the seal.

Preferably, with a closure assembly according to the invention comprising a seal and a separator, at least the separator and the seal are dimensioned such that when the closure assembly is mounted on the squeeze bottle, these elements are clamped between the squeeze bottle and the closure cap, more in particular the body part of the closure cap. Preferably, the separator element is of sufficient rigidity to keep the valve positioned against the closure cap when the assembly is mounted on the squeeze bottle.

This is especially beneficial when the dispensing opening of the closure cap has a diameter significantly smaller than the diameter of the dispensing opening of the squeeze bottle. Thus, the valve is kept in its position against the closure cap body part during the induction process for attaching the valve to the closure cap and/or, when using a two step induction process, prevent the valve from coming loose from the closure cap while induction sealing the seal to the squeeze bottle It should be clear to the skilled person that methods described above can, separate or in combination, be used to provide a squeeze bottle with a closure using a closure assembly according to the invention.

It is furthermore observed that seals and separators as such are known from the art for sealing squeeze bottles. The invention provides a valve that can be fixed to a closure cap body part by way of known induction techniques. The invention furthermore allows for combining this valve with sealing techniques and materials that as such are known in the prior art to enable attaching the valve to the closure cap while sealing the squeeze bottle.

Preferably, the induction elements in an assembly according to the invention are made of a metal foil material. Alternatively, metal wires can be used. Other suitable alternatives known in the prior art can be used as well.

Preferably, body part and/or valve, or other layers of material combined with the valve into a laminate material, are provided with retaining devices which prevent the valve from falling out of the recess of the closure cap when the closure assembly is positioned onto the squeeze bottle. For example the body part can be provided with protrusions, for example screw thread or click fingers, in the recess which hook behind the valve when it is placed inside the recess. Also, the valve, or for example a seal combined therewith into a multi-layer material, can be provided with radially extending flexible fingers, which engage screw thread provided inside the recess and thus secure the seal in the recess.

It is noted that the squeeze bottle according to the invention is a squeezable container for holding the substance to be dispensed. It is noted that the squeezable container can also be provide in the form of a pouch or tube. However, for the sake of brevity, in this text the container is referred to as a squeeze bottle only. It should be understood that the invention also comprises a squeeze bottle in which the bottle is provided in the form of a pouch or tube.

It is noted that additional elements can be added to the closure assembly according to the invention and additional layers of materials can be added to the multi-layer material according to the invention.

For example, a multi-layer material or laminate material according to the invention can be provided with a Radio frequency identification ("RFID") tag. A RFID tag comprises an integrated circuit and an antenna. The integrated circuit is used for storing and processing information, modulating and demodulating a radio-frequency (RF) signal, collecting DC power from the incident reader signal, and other specialized functions. The antenna is used for receiving and transmitting a signal. Two-way radio transmitter-receivers called interrogators or readers can be used to send a signal to the tag and read its response.

Thus a RFID tag can be used for identifying and locating an object provided with the tag. Combined with a multi-layer material according to the invention, a RFID tag may be utilized to track the multi-layer material it is part of, a closure assembly comprising said multi-layer material and/or a squeeze bottle provided with such a closure assembly. The multi-layer material can thus be tracked for example during assembly of a closure cap or squeeze bottle, subsequent transport and storage of the squeeze bottle, etc. Also, a RFID tag can be used to provide information concerning the products held by the container, such as the type of product, its location, its expiration date, an identification number, etc.

Integration of the RFID tag within a multi-layer material or laminate according to the invention, can enhance protection of the tag during the shipping and handling process. However, should an RFID tag contact a metallic layer for induction sealing the multi-layer material or laminate to the closure cap or squeeze bottle, the tag may be rendered completely inoperative, or the operational radius of the RFID tag may be significantly reduced. Therefore the TAG is preferably provided sealed in a substrate material which in turn can be combined as an additional layer with a multi-layer material or laminate according to the invention. In addition or alternatively, the RFID tag is provided adjacent or between layers of non-metallic material.

In an embodiment, the RFID tag forms a laminate with the valve, and thus is a permanent part of the closure assembly after the induction sealing process. In such an embodiment, the RFID tag is configured such that it does not block the central part of the valve. Preferably, the RFID tag and/or the layer or substrate it is provided in, is ring shaped comprising a loop shaped peripheral section that overlaps with the loop shaped attachment surface of the closure cap body part and the peripheral section of the valve, and a central section comprising an opening such that the RFID tag does not cover the central section of the valve, to allow use of the valve.

By providing a RFID tag as part of a laminate material comprising the valve, once the laminate has been induction sealed to the closure cap body part the tag cannot be removed from the closure assembly without rendering the closure assembly inoperable. This is beneficial when the tag is for example used as anti-theft device which cooperates with detectors provided in a store.

The invention claimed is:

1. A closure assembly for a squeeze bottle containing a substance, the squeeze bottle having a neck part with a dispensing opening, wherein the closure assembly is configured to be placed on the neck part of the squeeze bottle, the closure assembly comprising:

a closure cap, the closure cap having a cap part and a body part, wherein the body part is provided with a recess for receiving the neck part of the squeeze bottle, and wherein the body part is provided with a top wall, that forms the bottom of the recess, wherein the top wall has an outside surface and an inside surface, and has a dispensing opening for dispensing contents from the squeeze bottle on an outside of the closure cap body part, and wherein the top wall is on the inside surface provided with a loop shaped attachment surface extending around the dispensing opening, a valve, the valve arranged in said recess of the closure cap body part adjacent to the top wall such that the valve closes the dispensing opening, wherein the valve is a part of a multi-layer material, the multi-layer material comprising:

a layer of flexible foil material forming the valve, wherein the valve is a flat flexible foil material, and wherein the valve has a loop shaped peripheral section that overlaps the loop shaped attachment surface of the closure cap body part, and wherein the valve has a central section located in the dispensing opening of the closure cap body part, wherein the central section is provided with at least one through slit, thus forming a resilient, flat, self-closing valve of thermoplastic material, and a layer of metallic foil forming a first induction element, wherein the first induction element is arranged in said recess of the closure cap body part for induction sealing the loop shaped peripheral section of the valve to the loop shaped attachment surface of the closure cap body part, wherein the metallic foil layer has at least a loop shaped peripheral section that overlaps with the loop shaped peripheral section of the valve and the loop shaped attachment surface of the closure cap body part.

2. The closure assembly according to claim 1, the closure assembly further comprising:

a first separator element, the first separator element arranged in said recess of the closure cap body part, adjacent the first induction element to enable separating the first induction element from an object located on an opposite side of the separator element.

3. The closure assembly according to claim 2, further comprising:

a second separator element, and wherein the first and second separator elements are provided on opposite sides of the first induction element.

4. The closure assembly according to claim 2, the closure assembly further comprising:

a seal, the seal comprising at least a sealing layer for sealing the dispensing opening of the squeeze bottle, wherein the seal is arranged in the recess of the closure cap body part such that the first separator element is located between the valve and the seal, and wherein the seal has a loop shaped peripheral section that overlaps the loop shaped attachment surface of the closure cap body part.

5. The closure assembly according to claim 2, the closure assembly further comprising:

a seal, the seal comprising at least a sealing layer for sealing the dispensing opening of the squeeze bottle, wherein the seal is arranged in the recess of the closure cap body part such that the first separator element is located between the valve and the seal, and wherein the seal has a loop shaped peripheral section that overlaps the loop shaped attachment surface of the closure cap body part, and wherein the first induction element is ring shaped having a central opening such that the induction element does not cover the central section of the valve, and located adjacent the valve for induction sealing the valve to the closure cap body part, and wherein the assembly further comprises a second induction element, wherein the second induction element is arranged in the closure cap body part adjacent the seal for induction sealing the seal to the squeeze bottle.

6. The closure assembly according to claim 5, wherein the second induction element is a disc shaped metallic foil located between the first separator and the seal, and wherein the first separator is provided between the first and second induction elements.

7. The closure assembly according to claim 2, wherein the first and/or second separator element are/is an inlay, wherein the inlay is made of a compressible, non-thermoplastic material.

8. The closure assembly according to claim 3, wherein the first induction element covers the central section and the peripheral section of the valve, and the separator element preferably is disc shaped.

9. The closure assembly according to claim 1, wherein the first induction element is ring shaped and has a central opening such that the first induction element does not cover the central section of the valve.

10. The closure assembly according to claim 1, wherein the dispensing opening in the cap has a diameter between 12 mm and 20 mm.

11. The closure assembly according to claim 1, wherein the valve has a thickness in the range of 0.01 mm-1 mm, and is made of a polyolefin material, or is made of an elastomer material, or is made of a natural rubber material that on one side is provided with a sealing layer to enable induction sealing the natural rubber to the cap of the closure assembly.

12. The closure assembly according to claim 1, wherein the multi-layer material further comprises a first separation layer, wherein the first separation layer is arranged adjacent the metallic foil layer such that the metallic foil layer is located between the flexible foil layer and the first separation layer.

13. The closure assembly according to claim 12, wherein the multi-layer material further comprises a sealing layer of a seal.

14. The closure assembly according to claim 12, wherein the multi-layer material further comprises a second separation layer, wherein the first induction element is located in between the first and the second separation layers, and the first induction element and the separation layers are combined in a laminate that separates the valve layer from a seal.

15. A squeeze bottle assembly comprising the squeeze bottle and the closure assembly according to claim 1, wherein the squeeze bottle is provided with a neck part with a dispensing opening, and wherein the closure assembly and the squeeze bottle are each provided with an attachment device, wherein the attachment device is configured for attaching the closure cap body part on the neck part of the squeeze bottle, such that at least the valve and the first induction element are clamped in between the squeeze bottle and the cap.

16. The squeeze bottle assembly according to claim 15, wherein the squeeze bottle is provided with a flange, the flange defining the dispensing opening, wherein the flange matches the loop shaped attachment surface of the closure cap body part, such that when the cap is attached to the squeeze bottle, the peripheral section of the valve, and the peripheral section of the seal, are clamped between the loop shaped attachment surface of the closure cap body part and the loop shaped flange of the squeeze bottle.

17. A method for providing the closure assembly according to claim 1, the method comprising the steps:

providing the closure cap comprising the cap part and the body part;

providing the valve, positioning the valve in the body part of the closure cap;

providing the first induction element; and positioning the first induction element in the body part of the closure cap, wherein the valve and the first induction element are provided in the form of the multi-layer material or as a laminate and are positioned in the closure cap body part in a single step.

18. A method for providing the squeeze bottle with the closure assembly comprising the steps:

providing a dispenser squeeze bottle having a neck with a dispensing opening;

providing the closure assembly according to claim 1;

positioning the closure cap body part of the closure assembly, on the neck of the squeeze bottle such that at least the valve and the first induction element are clamped between an upper end of the squeeze bottle neck and the top wall of the closure cap body part; and induction sealing at least the valve to the closure cap body part.

19. The closure assembly according to claim 1, wherein the dispensing opening in the cap is at opposite ends of the slit at least 2 mm wider such that the diameter of the opening is equal to the length of the slit plus 4 mm or more.

20. A closure assembly for a squeeze bottle containing a substance, the squeeze bottle having a neck part with a dispensing opening, wherein the closure assembly is configured to be placed on the neck part of the squeeze bottle, the closure assembly comprising:

a closure cap, the closure cap having a cap part and a body part, wherein the body part is provided with a recess for receiving the neck part of the squeeze bottle, and wherein the body part is provided with a top wall, that forms the bottom of the recess, wherein the top wall has an outside surface and an inside surface, and has a dispensing opening for dispensing contents from the squeeze bottle on an outside of the closure cap body part, and wherein the top wall is on the inside surface provided with a loop shaped attachment surface extending around the dispensing opening;

a valve, the valve arranged in said recess of the closure cap body part adjacent to the top wall such that the valve closes the dispensing opening, wherein the valve is a flat flexible foil material, and wherein the valve has a loop shaped peripheral section that overlaps the loop shaped attachment surface of the closure cap body part, and wherein the valve has a central section located in the dispensing opening of the closure cap body part, wherein the central section is provided with at least one through slit, thus forming a resilient, flat, self-closing valve;

a first induction element, the first induction element arranged in said recess of the closure cap body part for induction sealing the loop shaped peripheral section of the valve to the loop shaped attachment surface of the closure cap body part, wherein the first induction element has at least a loop shaped peripheral section that overlaps with the loop shaped peripheral section of the valve and the loop shaped attachment surface of the closure cap body part;

a first separator element, the first separator element arranged in said recess of the closure cap body part adjacent the first induction element to enable separating the first induction element from an object located on an opposite side of the first separator element; and a second separator element, wherein the first and second separator elements are provided on opposite sides of the first induction element.

21. A closure assembly for a squeeze bottle containing a substance, the squeeze bottle having a neck part with a dispensing opening, wherein the closure assembly is configured to be placed on the neck part of the squeeze bottle, the closure assembly comprising:

a closure cap, the closure cap having a cap part and a body part, wherein the body part is provided with a recess for receiving the neck part of the squeeze bottle, and wherein the body part is provided with a top wall, that forms the bottom of the recess, wherein the top wall has an outside surface and an inside surface, and has a dispensing opening for dispensing contents from the squeeze bottle on an outside of the closure cap body part, and wherein the top wall is on the inside surface provided with a loop shaped attachment surface extending around the dispensing opening;

a valve, the valve arranged in said recess of the closure cap body part adjacent to the top wall such that the valve closes the dispensing opening, wherein the valve is a flat flexible foil material, and wherein the valve has a loop shaped peripheral section that overlaps the loop shaped attachment surface of the closure cap body part, and wherein the valve has a central section located in the dispensing opening of the closure cap body part, wherein the central section is provided with at least one through slit, thus forming a resilient, flat, self-closing valve;

a first induction element, wherein the first induction element is arranged in said recess of the closure cap body part for induction sealing the loop shaped peripheral section of the valve to the loop shaped attachment surface of the closure cap body part, wherein the first induction element has at least a loop shaped peripheral section that overlaps with the loop shaped peripheral section of the valve and the loop shaped attachment surface of the closure cap body part;

a first separator element, the first separator element arranged in said recess of the closure cap body part adjacent the first induction element to enable separating the first induction element from an object located on an opposite side of the first separator element; and a seal, the seal comprising at least a sealing layer for sealing the dispensing opening of the squeeze bottle, wherein the seal is arranged in the recess of the closure cap body part such that the first separator element is located between valve and the seal, and wherein the seal has a loop shaped peripheral section that overlaps the loop shaped attachment surface of the closure cap body part.

22. A closure assembly for a squeeze bottle containing a substance, the squeeze bottle having a neck part with a dispensing opening, wherein the closure assembly is configured to be placed on the neck part of the squeeze bottle, the closure assembly comprising:

a closure cap, the closure cap having a cap part and a body part, wherein the body part is provided with a recess for receiving the neck part of the squeeze bottle, and wherein the body part is provided with a top wall, that forms the bottom of the recess, wherein the top wall has an outside surface and an inside surface, and has a dispensing opening for dispensing contents from the squeeze bottle on an outside of the closure cap body part, and wherein the top wall is on the inside surface provided with a loop shaped attachment surface extending around the dispensing opening;

a valve, the valve arranged in said recess of the closure cap body part adjacent to the top wall such that the valve closes the dispensing opening, wherein the valve is a flat flexible foil material, and wherein the valve has a loop shaped peripheral section that overlaps the loop shaped attachment surface of the closure cap body part, and wherein the valve has a central section located in the dispensing opening of the closure cap body part, wherein the central section is provided with at least one through slit, thus forming a resilient, flat, self-closing valve;

a first induction element, wherein the first induction element is arranged in said recess of the closure cap body part for induction sealing the loop shaped peripheral section of the valve to the loop shaped attachment surface of the closure cap body part, wherein the first induction element has at least a loop shaped peripheral section that overlaps with the loop shaped peripheral section of the valve and the loop shaped attachment surface of the closure cap body part;

a first separator element, the first separator element arranged in said recess of the closure cap body part, adjacent the first induction element to enable separating the first induction element from an object located on an opposite side of the first separator element; and a seal, the seal comprising at least a sealing layer for sealing the dispensing opening of the squeeze bottle, wherein the seal is arranged in the recess of the closure cap body part such that the first separator element is located between valve and the seal, and wherein the seal has a loop shaped peripheral section that overlaps the loop shaped attachment surface of the closure cap body part, and wherein the first induction element is ring shaped having a central opening such that the induction element does not cover the central section of the valve, and located adjacent the valve for induction sealing the valve to the closure cap body part, and wherein the assembly further comprises a second induction element, wherein the second induction element is arranged in the closure cap body part adjacent the seal for induction sealing the seal to the squeeze bottle.

* * * * *